US010156089B2

(12) United States Patent
Bacon

(10) Patent No.: US 10,156,089 B2
(45) Date of Patent: Dec. 18, 2018

(54) FENESTRATION SUPPLEMENT SYSTEMS AND METHODS OF USE

(71) Applicant: Robert J. Bacon, Orford, NH (US)

(72) Inventor: Robert J. Bacon, Orford, NH (US)

( * ) Notice: Subject to any disclaimer, the term of this patent is extended or adjusted under 35 U.S.C. 154(b) by 0 days.

(21) Appl. No.: 15/457,849

(22) Filed: Mar. 13, 2017

(65) Prior Publication Data

US 2017/0268282 A1 Sep. 21, 2017

Related U.S. Application Data

(60) Provisional application No. 62/309,208, filed on Mar. 16, 2016.

(51) Int. Cl.

| | |
|---|---|
| ***E06B 3/968*** | (2006.01) |
| ***E06B 3/28*** | (2006.01) |
| *E06B 3/964* | (2006.01) |

(52) U.S. Cl.

CPC ..... *E06B 3/9681* (2013.01); *E06B 3/28* (2013.01); *E06B 3/9684* (2013.01); *E06B 3/285* (2013.01); *E06B 3/9641* (2013.01)

(58) Field of Classification Search

CPC ... E06B 1/345; E06B 9/52; E06B 1/36; E06B 3/9684; E06B 3/9681

USPC ..... 160/371–381

See application file for complete search history.

(56) References Cited

U.S. PATENT DOCUMENTS

| | | | | |
|---|---|---|---|---|
| 3,143,165 | A * | 8/1964 | Lewis | E04B 1/0046 160/179 |
| 3,222,841 | A * | 12/1965 | Lipof | A01K 1/03 160/394 |
| 4,690,192 | A * | 9/1987 | Stilling | E04H 15/04 160/395 |
| 5,732,760 | A | 3/1998 | Pattison | |
| 6,523,311 | B2 * | 2/2003 | Edger | E06B 1/36 52/204.593 |
| 7,877,962 | B2 * | 2/2011 | Teffenhart, Jr. | E04O 3/06 52/273 |
| 8,756,900 | B1 * | 6/2014 | Hudson | E04O 3/07 52/844 |

* cited by examiner

*Primary Examiner* — Babajide A Demuren
(74) *Attorney, Agent, or Firm* — Wolf, Greenfield & Sacks, P.C.

(57) ABSTRACT

Aspects disclosed herein relate to a fenestration supplement system and methods of using such a system. In one aspect, the fenestration supplement system includes a fenestration supplement frame member that is configured to accept three or more fenestration supplements. In another aspect, a fenestration supplement frame member has opposing first and second ends that each receives fenestration supplements, connectors and/or hardware (such as mounting hardware). In yet another aspect, a fenestration supplement frame member includes specially shaped grooves that can accept and retain different types of connectors.

18 Claims, 20 Drawing Sheets

FENESTRATION SUPPLEMENT SYSTEMS AND METHODS OF USE

CROSS-REFERENCE TO RELATED APPLICATIONS

This applicant claims the benefit of U.S. Provisional Application No. U.S. 62/309,208, filed Mar. 16, 2016, the contents of which are incorporated herein by reference.

FIELD

Aspects of the disclosure relate to fenestration supplement systems and methods of using such systems.

BACKGROUND

Fenestrations such as windows that are old, poorly sealed, improperly installed, or otherwise underperforming can provide inadequate thermal insulation, sound insulation and/or optical performance.

SUMMARY

According to one aspect, a fenestration supplement frame member includes an elongated body having a cross-section with a first axis in a first direction and a second axis in a second direction. The first and second directions are perpendicular to one another, and the elongated body has first, second and third connector grooves sized to receive and retain a connector. The first connector groove has a corresponding first abutment surface, the second connector groove has a corresponding second abutment surface and the third connector groove has a corresponding third abutment surface. The third abutment surface is spaced apart from the first abutment surface in the first direction and in the second direction, and the third abutment surface is spaced apart from the second connector groove in the first direction and in the second direction.

According to another aspect, a fenestration supplement frame member includes an elongated body and a first connector groove formed into the body. The first connector groove comprises a J-shaped flange and an angled indentation. The J-shaped flange and angled indentation define a space to receive a connector.

According to yet another aspect, a fenestration supplement system includes a fenestration supplement, a connector, and a first fenestration supplement member. The first fenestration supplement frame member includes an elongated body having first, second and third connector grooves sized to receive and retain the connector and a portion of the fenestration supplement. The first connector groove has a corresponding first abutment surface, the second connector groove has a corresponding second abutment surface, and the third connector groove has a corresponding third abutment surface. The connector couples the fenestration supplement to the first fenestration supplement frame member by holding the portion of the fenestration supplement inside the first connector groove. The third abutment surface is spaced apart from the first abutment surface in the first direction and in the second direction, and the third abutment surface is spaced apart from the second abutment surface in the first direction and in the second direction.

According to yet another aspect, a fenestration supplement frame member includes an elongated body having a left face, right face, upper portion, and lower portion. The elongated body has first and second upper connector grooves sized to receive and retain a connector, and first and second lower connector grooves sized to receive and retain a connector. The first and second upper connector grooves are positioned at the upper portion of the elongated body, and the first and second lower connector grooves are positioned at the lower portion of the elongated body.

According to yet another aspect, a fenestration supplement system includes a fenestration supplement, a connector and a first fenestration supplement frame member comprising an elongated body having first, second and third connector grooves sized to receive and retain the connector and a portion of the fenestration supplement. The first connector groove has a corresponding first abutment surface, the second connector groove has a corresponding second abutment surface, and the third connector groove has a corresponding third abutment surface. The system also includes an accessory coupled to the first fenestration supplement frame member. The connector couples the fenestration supplement to the first fenestration supplement frame member by holding the portion of the fenestration supplement inside the first connector groove. The third abutment surface is spaced apart from the first abutment surface in the first direction and in the second direction, and the third abutment surface is spaced apart from the second abutment surface in the first direction and in the second direction.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
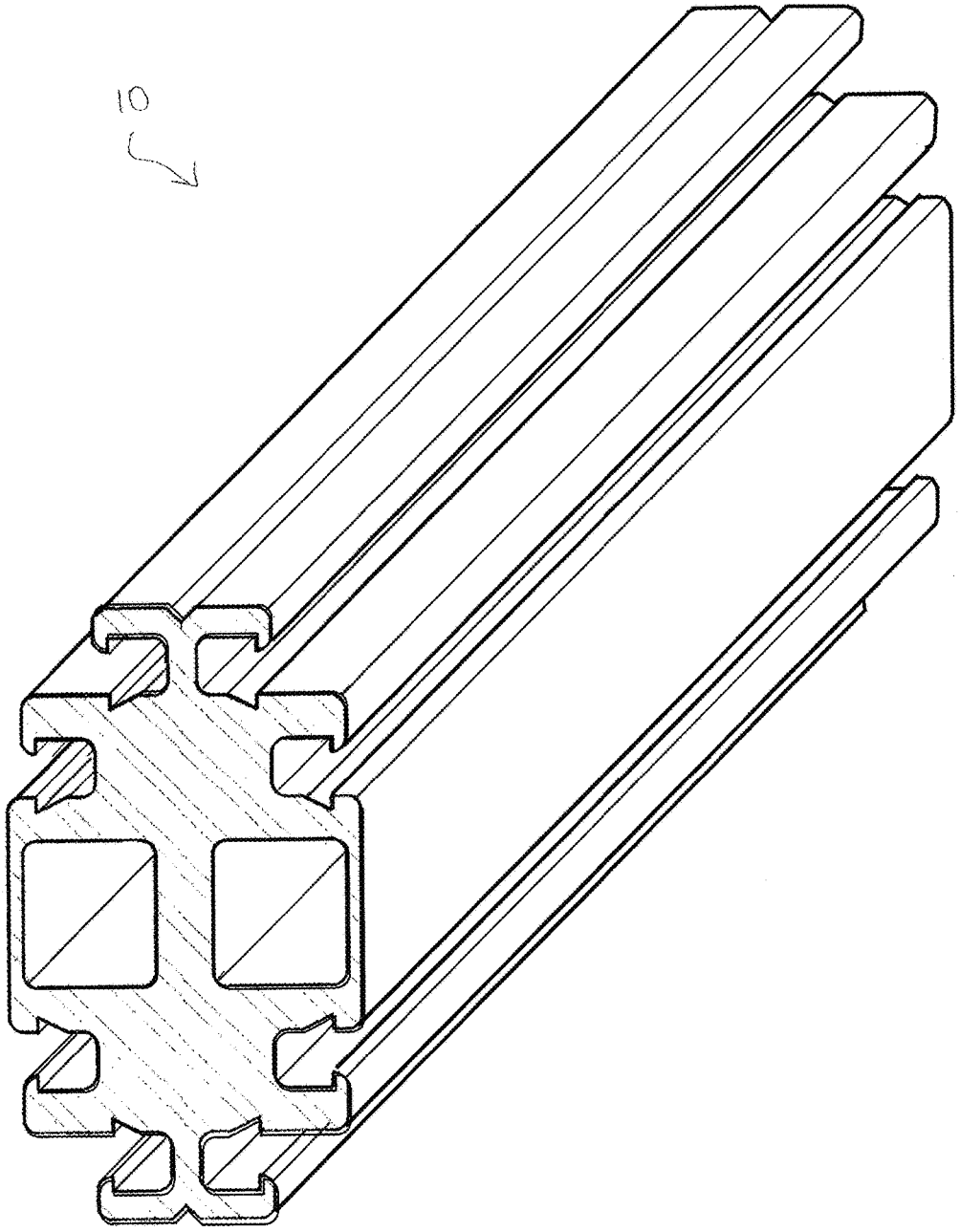
FIG. 1 is an isometric view of a fenestration supplement frame member according to one embodiment.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Aspects of the present disclosure relate to fenestration supplement systems and to methods of using such systems. As used herein, a "fenestration" refers to windows, doors, skylights and other similar covers to building openings, whether openable or fixed. A fenestration supplement is a component that is added to a fenestration to supplement the fenestration, e.g., for temperature insulation, sound insulation, screening (e.g. screening out insects/debris), tinting (e.g. for UV shielding or other optical properties), etc. While aspects of the fenestration supplement system may be discussed in relation to a window, it should be appreciated that such systems may be used with other types of fenestration, such as doors and skylights.

Historically, the most common method of improving the performance of existing fenestration has been, and continues to be, their removal and replacement with new units. The inventor has appreciated that replacing existing windows and doors with better performing units of the same size and appearance is expensive, and measures taken to reduce cost often result in a dramatic change in the building's appearance. Especially with regard to buildings that are old, historic, or otherwise have a distinct appearance, window replacement can be undesirable to those looking to preserve the exterior appearance of the building.

As a consequence of these drawbacks, many old, historically significant or architecturally distinctive structures are effectively prevented from replacement as a method of improving the thermal, acoustic and optical performance of their fenestration; and thus suffer from inconvenience, discomfort and energy inefficiency; i.e., higher than necessary operating costs.

The inventor has thus recognized a need for a fenestration supplement panel that can be used with existing fenestrations without altering the existing fenestration or changing the appearance of the building exterior.

Supplemental fenestration panels offer an alternative to window and/or door replacement. The inventor has recognized that existing supplemental fenestration panels have operational and performance limitations. Many existing supplemental fenestration panels need to be removed and reinstalled seasonally to enable operation of the existing window or door. In addition, many existing supplemental fenestration panels cannot accommodate spectrally selective surface applied films to improve optical performance in conjunction with multiple layers of transparent film in suspension to improve thermal performance. Window films can result in air pockets, can distort visibility through the window, and/or can interfere with the operation of the window, e.g., the film must be removed before the window can be opened. The inventor has thus recognized a need for a fenestration supplement panel that can be used with existing fenestrations without interfering with the function of the fenestration.

Examples of fenestration supplements include a flexible film membrane, a rigid membrane or a screen.

In some embodiments, the fenestration support system described herein is a custom-configurable, interior-mounted, supplemental panel system that enables improvements in the thermal, optical, and acoustical performance of all types of fenestration in many different types of building, occupancy and climate zone, providing an attractive, high-performance, and cost-effective alternative to window replacement. In some embodiments, the system includes: a) frame members and frame member connecting devices; b) fenestration supplements such as glazing membranes; c) connectors that attach the fenestration supplements to the frame members; and d) accessories that mate to the frame members. The frame members, frame member connecting devices, fenestration supplements and connectors combine to form what is referred to herein as a panel assembly or a panel.

The system components mechanically attach (or mate) to each other without requiring the use of additional hardware. In some embodiments, the panel assembly is fitted into the window or other fenestration opening using compression seals, or may be attached onto the surrounding trim or wall surface via commonly available screw and/or clip hardware.

In some embodiments, the completed panel assembly is installed on the interior (room side) side of the window or other fenestration in an orientation coplanar with the existing glazing. The panel mounting location relative to the window and the method of panel attachment are determined by the window/wall construction, the trim configuration and the type and location of any additional interior window treatments. Mounting may accomplished by using mating attachment accessories having integral air seals.

In some embodiments, the fenestration support system described herein may differ from currently available fenestration performance improvement products in one or more ways. First, in some embodiments, in addition to its application as a convenient, seasonably removable window treatment device, the fenestration supplement system can be configured for hinged or sliding operation. Second, in some embodiments, the fenestration supplement system can be configured to accommodate surface-applied spectrally-selective films well as suspended film membranes thus allowing the system to improve the optical as well as the thermal performance of the fenestration. Third, in some embodiments, the fenestration supplement system is able to accommodate as many as four thin-film membranes creating three insulating still air spaces within the thickness of the panel. It should be appreciated that, in other embodiments, the system is able to accommodate a different number of membranes or other fenestration supplement members. Fourth, in some embodiments, the system is able to easily accommodate the attachment of additional window treatment devices such as shades, blinds, curtains, etc.

Frame Elements

In some embodiments, a fenestration supplement panel consists of a rigid perimeter frame that is sized and shaped so that the completed assembly conforms specifically to the size and shape of its target opening. The completed assembly may form an air-tight seal between the conditioned interior space and the existing window/fenestration. In transverse cross-section, the outer profile of the frame may be comprised of specially shaped grooves and lands that are circumscribed symmetrically within an overall rectangular shape whose profile and dimensions remain uniform throughout its length. The first and second axes of the frame member cross-section correspond respectively with the longer and shorter dimensions of the cross-section. The third axis of each frame member corresponds with its length, the dimension of which is determined by the type of mounting desired and the size of the opening to which the panel is to be fitted.

The outer surfaces of the frame member that are parallel to the frame member's cross-sectional first axis are referred to as the "faces" of the profile, while those outer surfaces parallel to the second axis are referred to as its "edges." The extremities of each member's length (third axis) are known as the "ends." In some embodiments, a frame member can be said to have: two faces, two edges, and two ends.

In some embodiments, the longer cross-sectional first axis of a frame member is positioned parallel to the plane of window glazing. As a consequence, the shorter cross-sectional second axis of the frame member is positioned perpendicular to the plane of the glazing, resulting in an assembled panel whose glazing membranes and thinnest cross-sectional profile are co-planar with the existing window.

In some embodiments, a panel assembly may be fitted into the finished window opening or onto the wall and/or trim surrounding the window opening while maintaining an air-tight seal.

Frame Member Connectors

A perimeter frame member may be attached to adjacent, abutting members by means of one or more frame member connectors that insert into the internal voids of the frame member. Such an arrangement may generate sufficient friction to hold the frame members together after assembly. The frame member connectors may also preserve the continuity and alignment of the groove and land profiles from the abutting frame members across the facial surfaces of the frame member connector and likewise preserve the continuity and alignment of the "centering" (in some embodiments, V-shaped) groove of the abutting frame member across the outside edges of the frame member connector.

According to one aspect, the fenestration supplement system includes three frame member connectors to accommodate fixed 90° corner configurations: "L"=typical outside corner; "T"=typical intersection creating two inside corners; and, "+"=typical crossing intersection creating four inside corners; as well as an adjustable, completely concealed connecting prong for non-90° conditions.

Fenestration Supplements

In some embodiments, a fenestration supplement system can accommodate up to four thin-film membranes yielding three insulating still air spaces—all within the ¾" edge thickness of the frame member. This membrane configuration may yield a conductive thermal resistance of approximately R-4.

Alternatively, in some embodiments, the system can accommodate a rigid sheet located near the center of the edge thickness. As an example, this rigid sheet can be installed in conjunction with up to two thin film membranes—one on either side of the rigid sheet, yielding two insulating still air spaces.

Alternatively or in addition, in some embodiments, the system can accommodate a woven screen membrane that can be used as an insect screen.

Fenestration Supplement Connectors

In some embodiments, to accommodate various fenestration supplement materials and thicknesses, the receiving grooves of the frame elements allow for the use of compressible connectors or snap-in connectors. In some cases, snap-in connectors may be subject to less shape distortion over time as compared to compressible connectors. In some cases, compressible splines may be used to attach thicker or less elastic glazing membranes such as some heavy vinyl films and mesh screens.

Accessories

According to one aspect, a variety of accessories may attach to the frame members. Such accessories may help to enable a wide range of panel applications, operation and appearance. The accessories may fit into the grooves of the frame members, and/or the accessories may insert into the voids located within the frame members. The accessories may attach to the frame by mechanical (snap-in) means, by friction/interference fit, by the tension/compression forces inherent within the panel assembly, or by any other suitable means. Examples of accessories used to accommodate and preserve window operation include: a hinge, meeting rail, lift/slide handle, pull tab, slide lock, astragal and sliding and receiving track. Examples of accessories used for attachment include: a panel to structure connector ("structure" referring to structure surrounding the window/fenestration, e.g., window trim or wall), a muntin to muntin connector, a muntin to frame positioner and brackets for connecting third party window treatment to frame members. Examples of accessories used for air-sealing include: edge caps with compressible perimeter gasket in ⅜", ½", ¾" or any other suitable size in uncompressed thickness, a gasketed meeting rail, gasketed astragal, and a face gasket for surface mounted frames. Accessories may also used be for aesthetic purposes: e.g., ungasketed edge caps.

Using a Fenestration Supplement Panel with Non-Square or Irregular Openings

Improving the thermal performance of existing windows in cold climates represents a significant segment of the replacement window market. This market segment also represents a high demand for window improvement products. Old buildings benefit from insulative window treatment products because they have leaky single glazed windows. Often times, in old buildings, walls are out-of-plumb, floors are out-of-level, and doors and windows to become out-of-square. Because building owners often prefer that their window treatment system be installed within the window opening whenever possible, rather than upon the surrounding wall or window trim, these conditions are a common challenge to the custom fitment of rigid rectangular window treatments into non-rectangular openings.

According to one aspect, the fenestration supplement system addresses the problem of non-squareness and other challenges of irregularity common to old buildings by incorporating perimeter air-seal gaskets of various thickness that snap onto the frame. Placed in compression by insertion of the panel into the opening, these gaskets hold the panel in place while accommodating variations in the straightness, the squareness and/or the uniformity or flatness of the surrounding bearing surfaces. These snap-in devices can be simply chosen or exchanged during installation as required to assure an ideal snug and air-tight fit, thus obviating the need and expense of returning and rebuilding the panel frame itself.

Illustrative Embodiments

In accordance with one aspect, a fenestration supplement frame member for a fenestration supplement panel is configured to accept three or more fenestration supplements.

Figure 2:
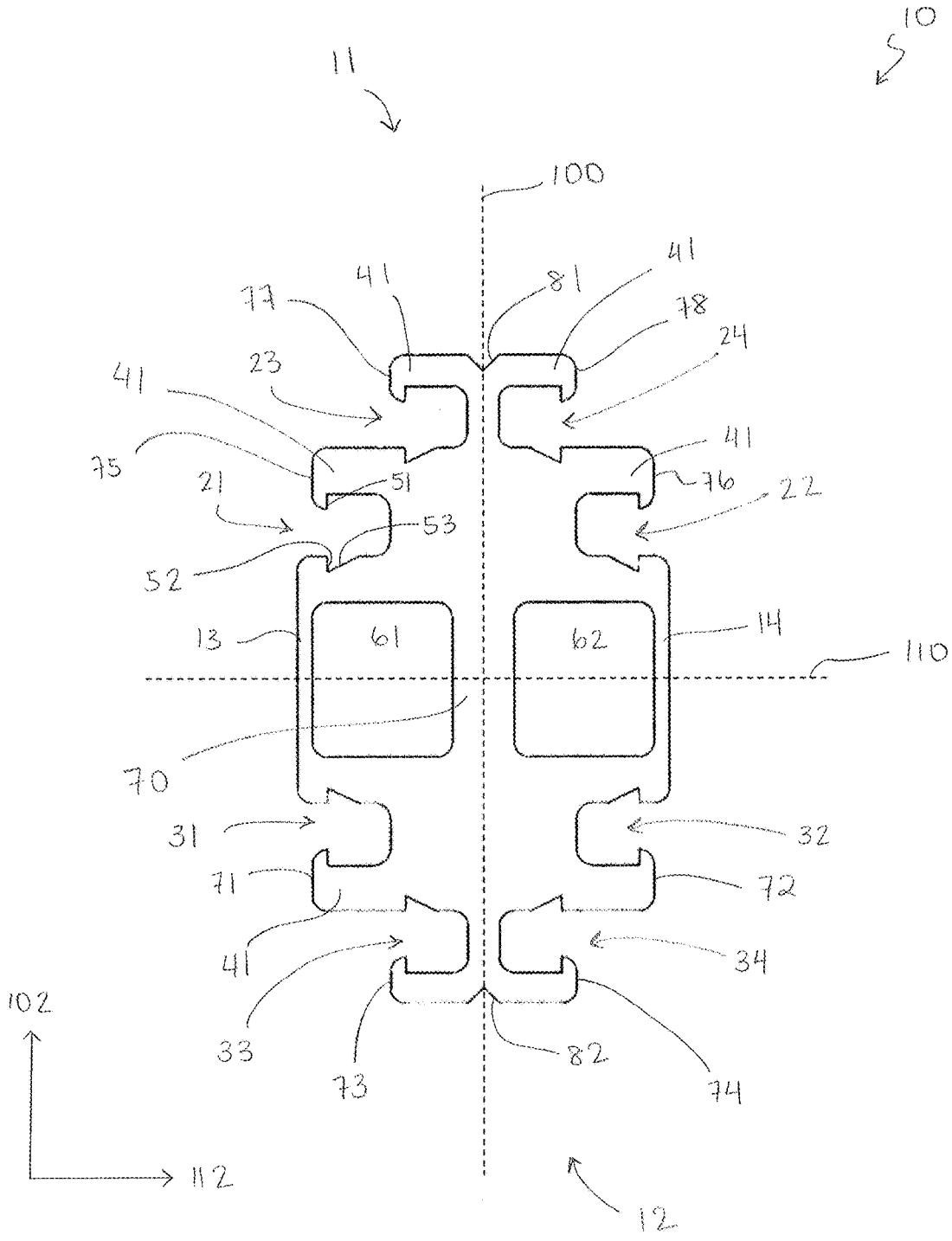
FIG. 2 is a vertical cross-section of the frame member shown in FIG. 1.

Turning to the figures, FIG. 1 depicts a perspective view of one embodiment of a fenestration frame member 10. FIG. 2 is a vertical cross-section of the frame member shown in FIG. 1. The frame member 10 includes a first axis 100 in a first direction 102 and a second axis 110 in a second direction 112. The first and second directions 102, 112 are perpendicular to one another, and thus the first and second axes 100, 110 are also perpendicular to one another. The frame member 10 has a first portion 11 and a second portion 12. When held in the orientation shown in FIG. 2, i.e. where the first portion 11 faces vertically upwardly and the second portion 12 faces vertically downwardly, the first portion 11 is an upper portion and the second portion 12 is a lower portion.

Figure 8:
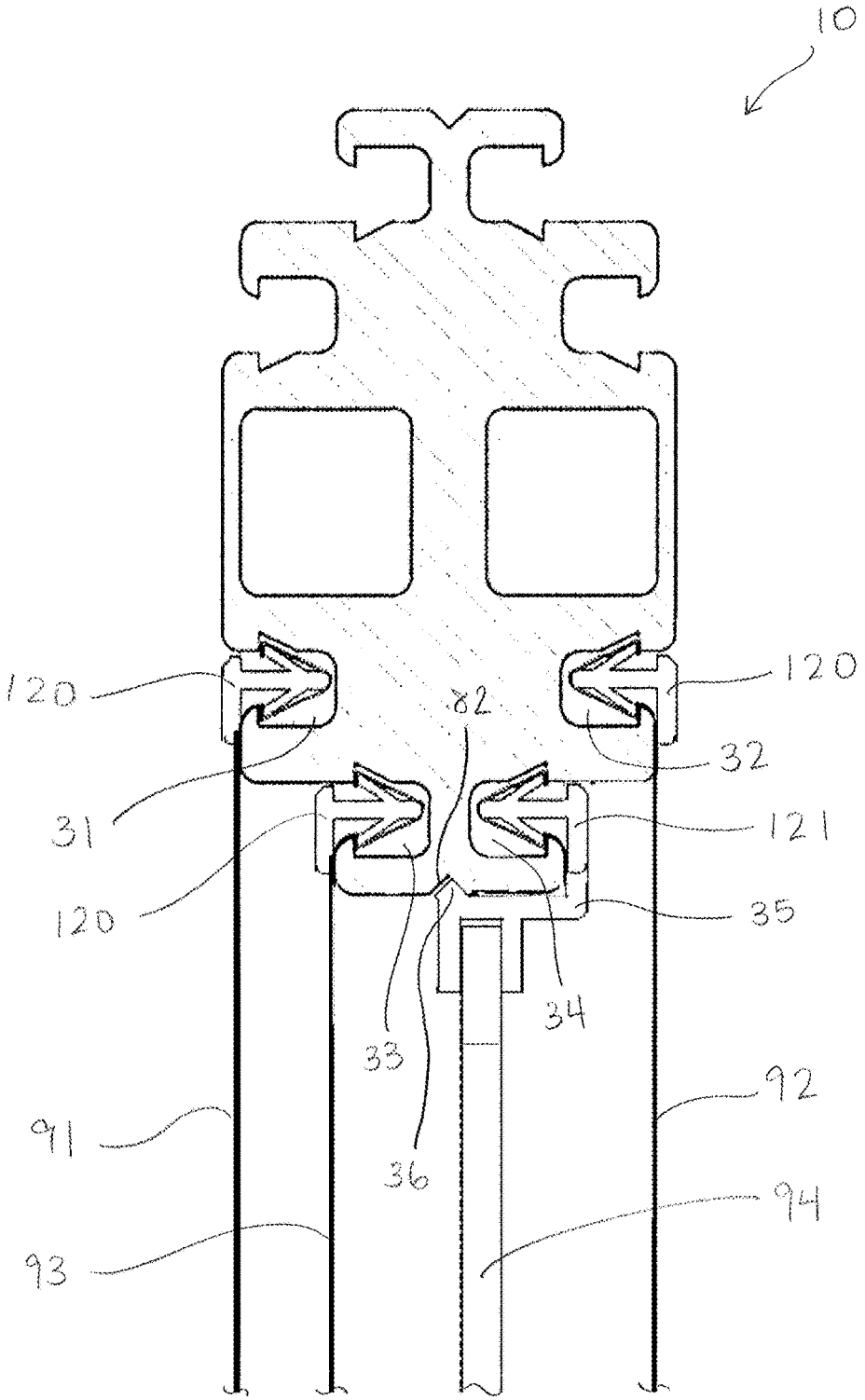
FIG. 8 is an enlarged view of a fenestration supplement frame member with snap-in connectors coupling fenestration supplements to the frame member according to one embodiment.

In one embodiment, the frame member 10 has a plurality of lower grooves 31, 32, 33, and 34. Each of these grooves is sized, shaped and arranged to receive a connector or other connector that is used to couple a fenestration supplement to the frame member. For example, FIG. 8 shows a plurality of connectors 120 received within the grooves 31, 32, 33, 34. As will be discussed in more detail, the connectors 120 couple the fenestration supplements 91, 92, 93, 94 to the frame member 10. As will be discussed in further detail, the grooves can also receive other types of hardware besides connectors. As seen in FIG. 2, the grooves 31, 32, 33, 34 are positioned such that each groove can accept a connector, thus permitting the grooves at the lower portion of the frame member to accommodate four fenestration supplements. The lower portion of the frame member has a first lower groove 31, a second lower groove 32 and a third lower groove 33.

In some embodiments, each of the grooves has a corresponding abutment surface. A fenestration supplement that is received within a groove rests against the groove's corresponding abutment surface. In some embodiments, a connector is insertable into the groove in a first direction, and a normal to the groove's corresponding abutment surface is parallel to that first direction. In some embodiments, the connector is insertable into a groove in a direction parallel to one of the bisecting axes of the frame member.

As an illustrative example, each of the lower grooves 31, 32, 33, 34 of the frame member 10 of FIG. 2 has a corresponding abutment surface. Surface 71 corresponds to groove 31, surface 72 corresponds to groove 32, surface 73 corresponds to groove 33 and surface 74 corresponds to groove 34. In some cases, because the fenestration supplement member or a connector holding a supplement member abuts against the abutment surface, the position of the abutment surface determines the position of the supplement member. See, for example, FIGS. 8-9 and 11-12.

The third lower surface 73 is spaced apart from the first lower surface 71 in the first direction 102 and in the second direction 112. The third lower surface 73 is also spaced apart from the second lower surface 72 in the first direction 102 and in the second direction 112. This offset between the third lower surface 73 relative to the first and second lower surfaces 71, 72 in both the first and second directions 102, 112 permits the frame member 10 to accommodate a third fenestration supplement.

In some embodiments, the frame member has only three lower grooves. In other embodiments, the frame member includes a fourth lower groove 34. The fourth lower groove 34 may have a corresponding abutment surface 74 that may be spaced from the third lower surface 73 in the second direction 112. Similar to the third lower surface, the fourth lower surface 74 is spaced apart from the first lower surface 71 in the first direction 102 and in the second direction 112. The fourth lower surface 74 is also spaced apart from the second lower surface 72 in the first direction 102 and in the second direction 112. This offset between the fourth lower surface 74 relative to the first and second lower surfaces 71, 72 in both the first and second directions 102, 112, as well as the offset between the third and fourth lower surfaces 73, 74 in the second direction 112 permits the frame member 10 to accommodate a fourth fenestration supplement.

In some embodiments, the first and second lower surfaces 71, 72 are aligned along the second direction 112 and spaced apart in the second direction. Additionally or alternatively, in some embodiments, the third and fourth lower surfaces 73, 74 are aligned along the second direction 112 and spaced apart in the second direction.

In some embodiments, the grooves corresponding to each of the abutment surfaces may be similarly spaced apart. The third lower groove 33 may be spaced apart from the first lower groove 31 in the first direction 102 and in the second direction 112. The third lower groove 33 may also be spaced apart from the second lower groove 32 in the first direction 102 and in the second direction 112. In embodiments having a fourth lower groove, the fourth lower groove 34 may be spaced from the third lower groove 33 in the second direction 112. Similar to the third lower groove, the fourth lower groove 34 may be spaced apart from the first lower groove 31 in the first direction 102 and in the second direction 112. The fourth lower groove 34 may also be spaced apart from the second lower groove 32 in the first direction 102 and in the second direction 112. In other embodiments, however, two or more lower grooves may be aligned in a direction along the first direction 102. Alternatively or in addition, three or more lower grooves may be aligned in a direction along the second direction 112.

In some embodiments, the first and second lower grooves 31, 32 are aligned along the second direction 112 and spaced apart in the second direction. Additionally or alternatively, in some embodiments, the third and fourth lower grooves 33, 34 are aligned along the second direction 112 and spaced apart in the second direction.

Conventional frame members for fenestration supplement panels have only one end with grooves that accept fenestration supplements, splines and/or hardware. The other opposing end of these conventional frame members has no such grooves. The inventor has recognized that providing grooves on both ends of the frame member permits the frame member to be used in various possible configurations.

In accordance with yet another aspect, the fenestration supplement frame member for a fenestration support panel has opposing first and second ends that each receives fenestration supplements, connectors and/or other hardware (such as mounting hardware).

As seen in FIG. 2, both the first portion 11 and the second portion 12 of the frame member 10 include a plurality of grooves configured to receive fenestration supplements, connectors, other connectors and/or other hardware.

The first portion 11 includes upper grooves 21, 22 and 23. Each of the upper grooves may have corresponding abutment surfaces which may be arranged in a manner similar to that of the lower surfaces 71, 72, 73, 74 discussed above. Specifically, the third upper surface 77 may be spaced apart from the first upper surface 75 in the first direction 102 and in the second direction 112. The third upper surface 77 may also be spaced apart from the second upper surface 76 in the first direction 102 and in the second direction 112. This offset between the third upper surface 77 relative to the first and second upper surfaces 75, 76 in both the first and second directions 102, 112 permits the frame member 10 to accommodate a third fenestration supplement and/or additional hardware.

In some embodiments, the first portion 11 may include a fourth upper groove 24. The abutment surface 78 corresponding to the fourth upper groove 24 may be spaced from third upper surface 77 in the second direction 112. The fourth upper surface 78 may be spaced apart from the first upper surface 75 in the first direction 102 and in the second direction 112. The fourth upper surface 78 may also be spaced apart from the second upper surface 76 in the first direction 102 and in the second direction 112. This offset between the fourth upper surface 78 relative to the first and second upper surfaces 75, 76 in both the first and second directions 102, 112, as well as the offset between the third and fourth upper surfaces 77, 78 in the second direction, permits the frame member to accommodate a fourth fenestration supplement and/or additional hardware.

In some embodiments, the first and second upper surfaces 75, 76 are aligned along the second direction 112 and spaced apart in the second direction. Additionally or alternatively, in some embodiments, the third and fourth upper surfaces 77, 78 are aligned along the second direction 112 and spaced apart in the second direction.

In some embodiments, the grooves corresponding to each of the abutment surfaces may be similarly spaced apart. Specifically, the third upper groove 23 may be spaced apart from the first upper groove 21 in the first direction 102 and in the second direction 112. The third upper groove 23 may also be spaced apart from the second upper groove 22 in the first direction 102 and in the second direction 112. In embodiments having a fourth upper groove, the fourth upper groove 24 may be spaced from third upper groove 23 in the second direction 112. The fourth upper groove 24 may be spaced apart from the first upper groove 21 in the first direction 102 and in the second direction 112. The fourth upper groove 24 may also be spaced apart from the second upper groove 22 in the first direction 102 and in the second direction 112. In other embodiments, however, two or more of the upper grooves may be aligned in a direction along the first direction 102. Alternatively or in addition, three or more of the upper grooves may be aligned in a direction along the second direction 112.

Having grooves at both portions 11, 12 of the frame member 10 allows the frame member 10 to be used in a variety of configurations. As one illustrative example, the second portion 12 may couple to one or more fenestration supplements, while the first portion 11 may couple to mounting hardware used to mount the frame member to a window.

Figure 3:
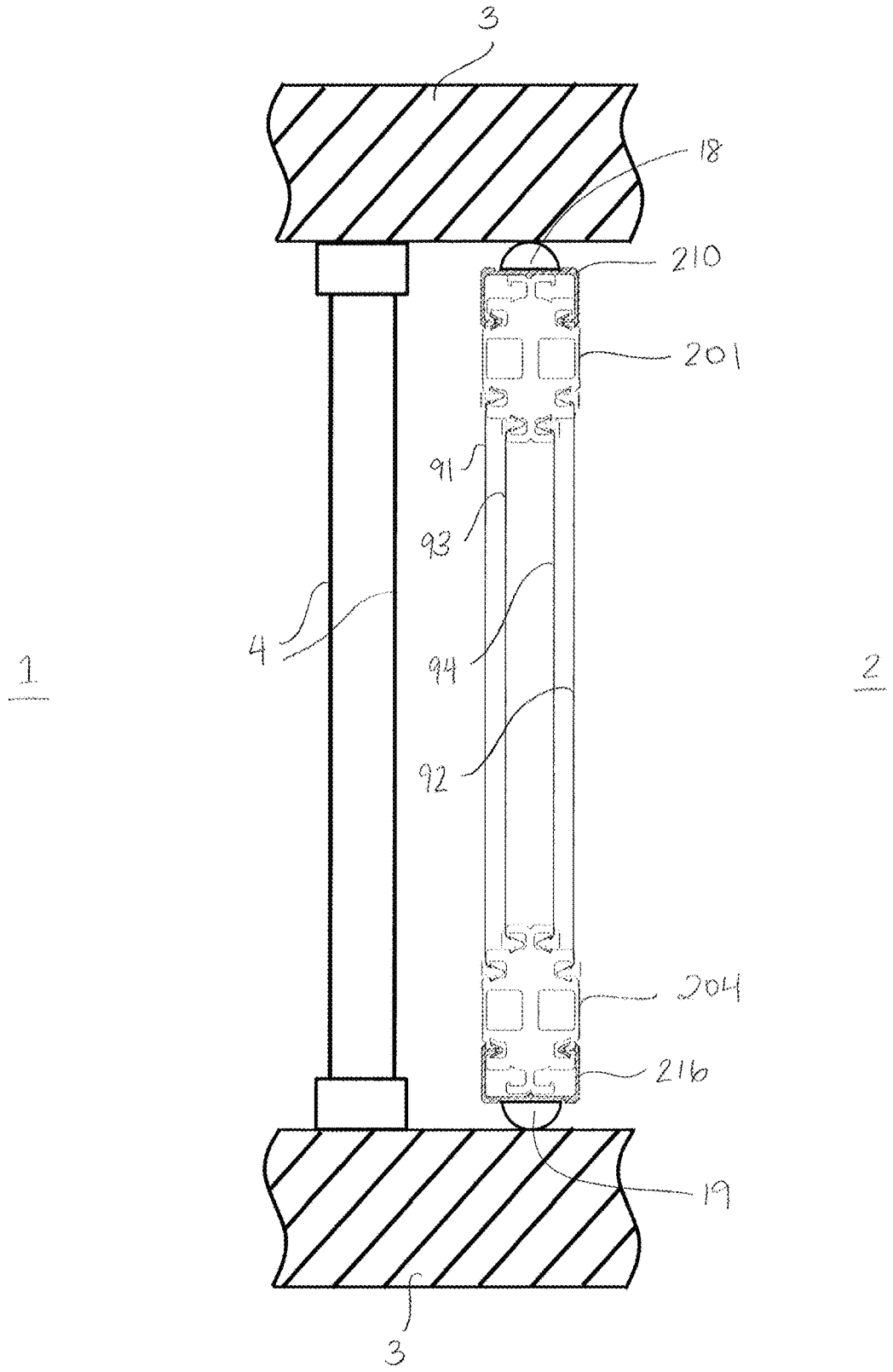
FIG. 3 is a vertical cross-section of a fenestration supplement system incorporated with a window according to one embodiment.

One illustrative embodiment is shown in FIG. 3, which is a cross-section of a fenestration supplement panel incorporated with a window. The window consists of two window glasses 4 that extend across an opening in the wall 3. The window glasses 4 separate the exterior side 1 from the interior side 2.

Figure 15:
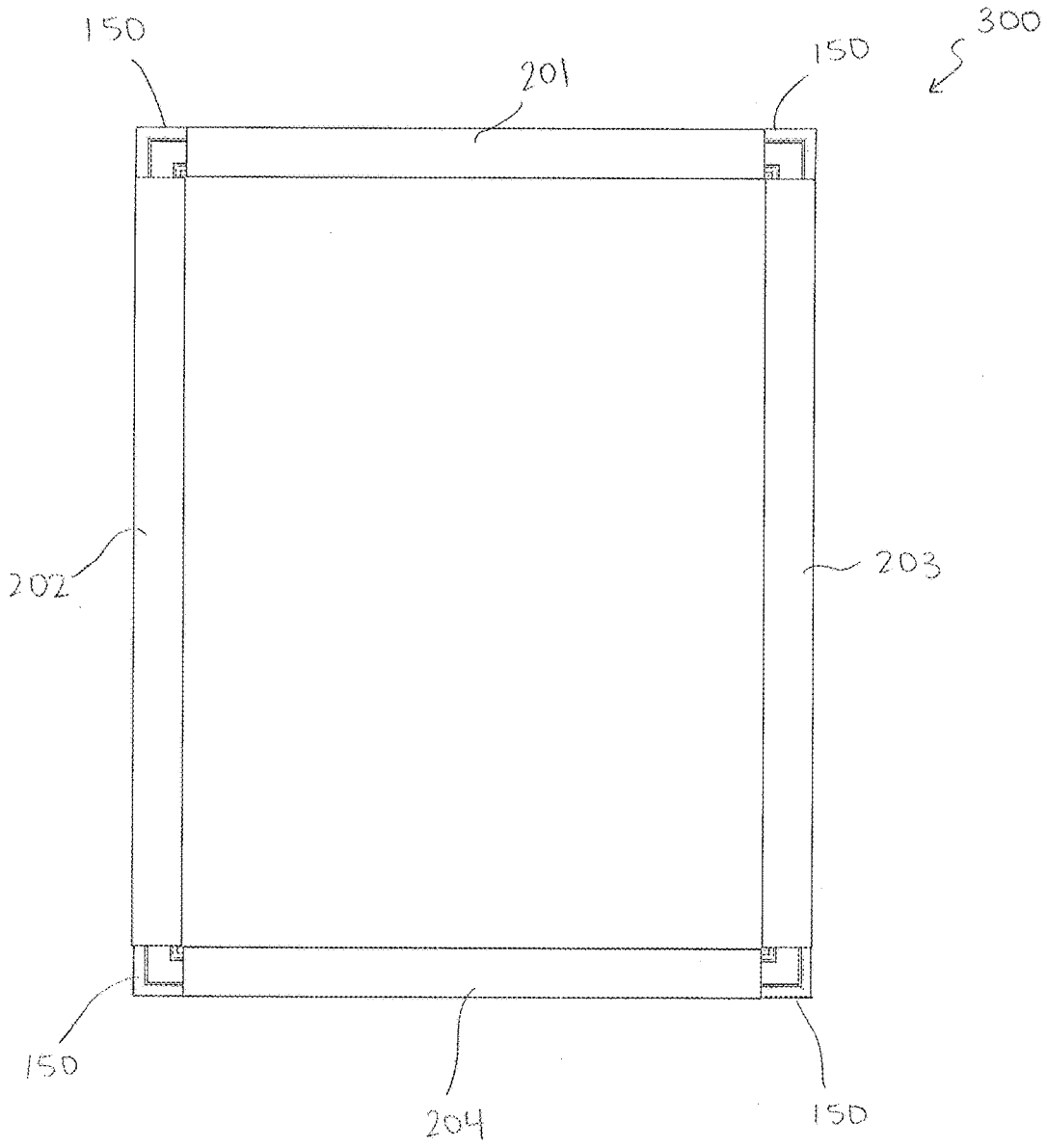
FIG. 15 depicts four frame members joined together to form a fenestration supplement frame.

In this illustrative embodiment, the fenestration supplement panel is located on the interior side 2, and includes four frame members that are combined together to form a square or rectangular frame, as seen in FIG. 15 and discussed in more detail a later section. The first frame member 201 and fourth frame member 204 are visible in FIG. 3, while the second frame member is in front of the plane of the page and the third frame member is behind the plane of the page. In this embodiment, the fenestration supplement frame holds four fenestration supplements 91, 92, 93 and 94. The top end portions of the fenestration supplements 91-94 are coupled to the lower grooves of the first frame member 201, while the bottom end portions of the fenestration supplements are coupled to the upper grooves of the fourth frame member 204.

Because the frame members each have two portions, the free portions that are not coupled to fenestration supplements can be used to mount the frame to the window environment. In the embodiment shown in FIG. 3, the upper portion of the first frame member 201 is attached to an end cap 210, and the lower portion of the fourth frame member 204 is attached to an end cap 216. A gasket 18 may be sandwiched between the end cap 210 and the wall 3 to create an airtight seal. Another gasket 19 may be sandwiched between the end cap 216 and the wall 3 to create an airtight seal.

It should be appreciated that the embodiment shown in FIG. 3 is only one example in which a panel assembly can be mounted to a fenestration environment. In some embodiments, as will be discussed in detail in a later section, the free portions of the frame members that are not coupled to fenestration supplements can be coupled to different types of mounting hardware that allow the frame to be movably coupled to the window environment, (e.g. slidable or pivotable).

Figure 4:
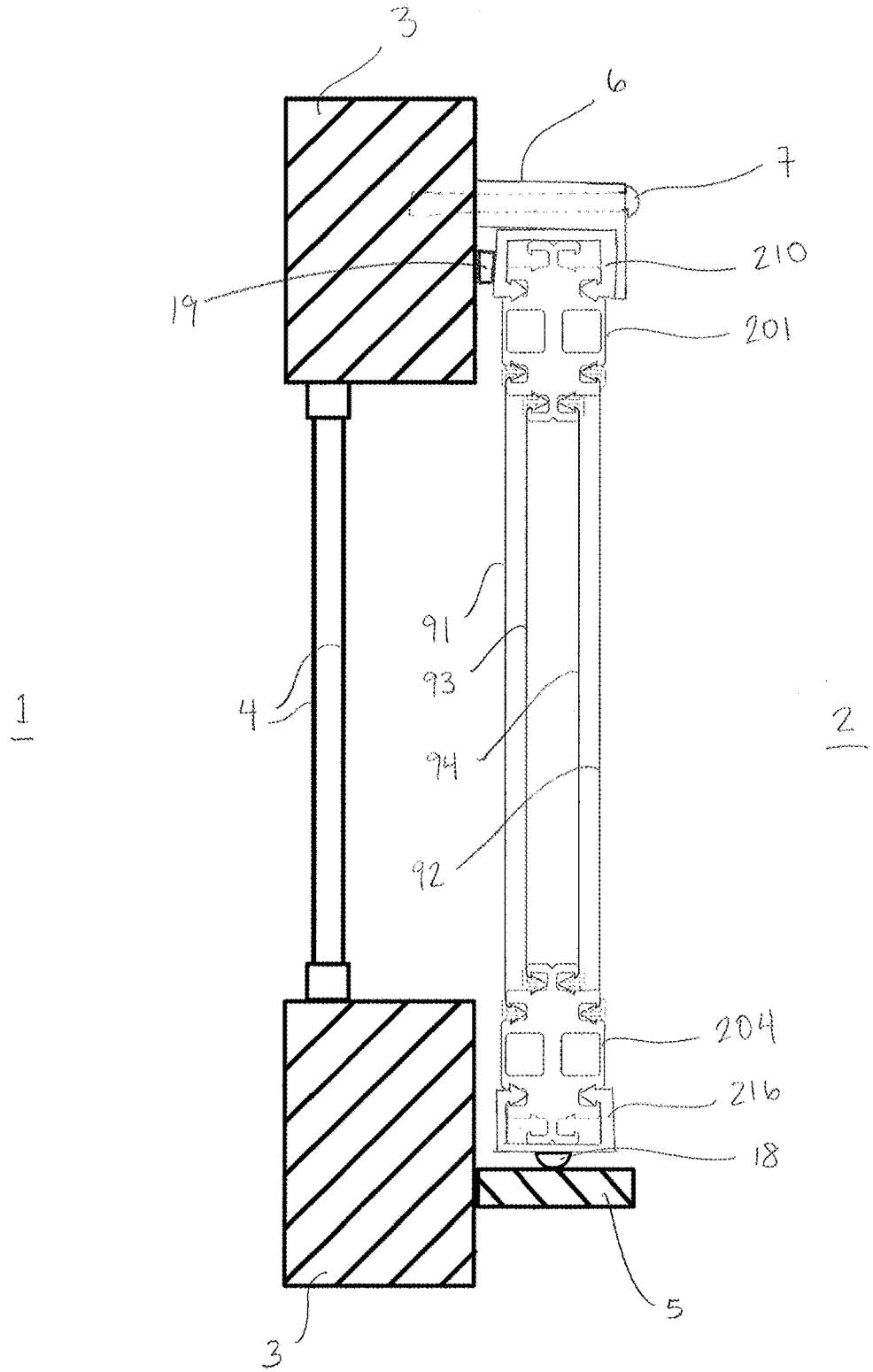
FIG. 4 is a vertical cross-section of a fenestration supplement system incorporated with a window according to another embodiment.

Another illustrative embodiment is shown in FIG. 4, which is also a cross-section of a fenestration supplement panel incorporated with a window. In this embodiment, an interior sill 5 is attached to the wall 3 on the interior side 2. In the embodiment shown in FIG. 4, the upper portion of the first frame member 201 is attached to an end cap 210.

Mounting bracket 6, along with screw 7, is used to attach the end cap 210 to the wall 3. A gasket 19 may be sandwiched between the end cap 210 and the wall 3 to create an airtight seal. The lower portion of the fourth frame member 204 is attached to an end cap 216. A gasket 18 may be sandwiched between the end cap 216 and the interior sill 5 to create an airtight seal.

According to one aspect, a fenestration supplement panel may be used at one or more locations relative to a window frame. For example, the fenestration supplement panel may be used on the exterior side or interior side of a window. Different attachment mechanisms may be used to attach the panel to the window frame, trim and/or surrounding wall.

Figure 5:
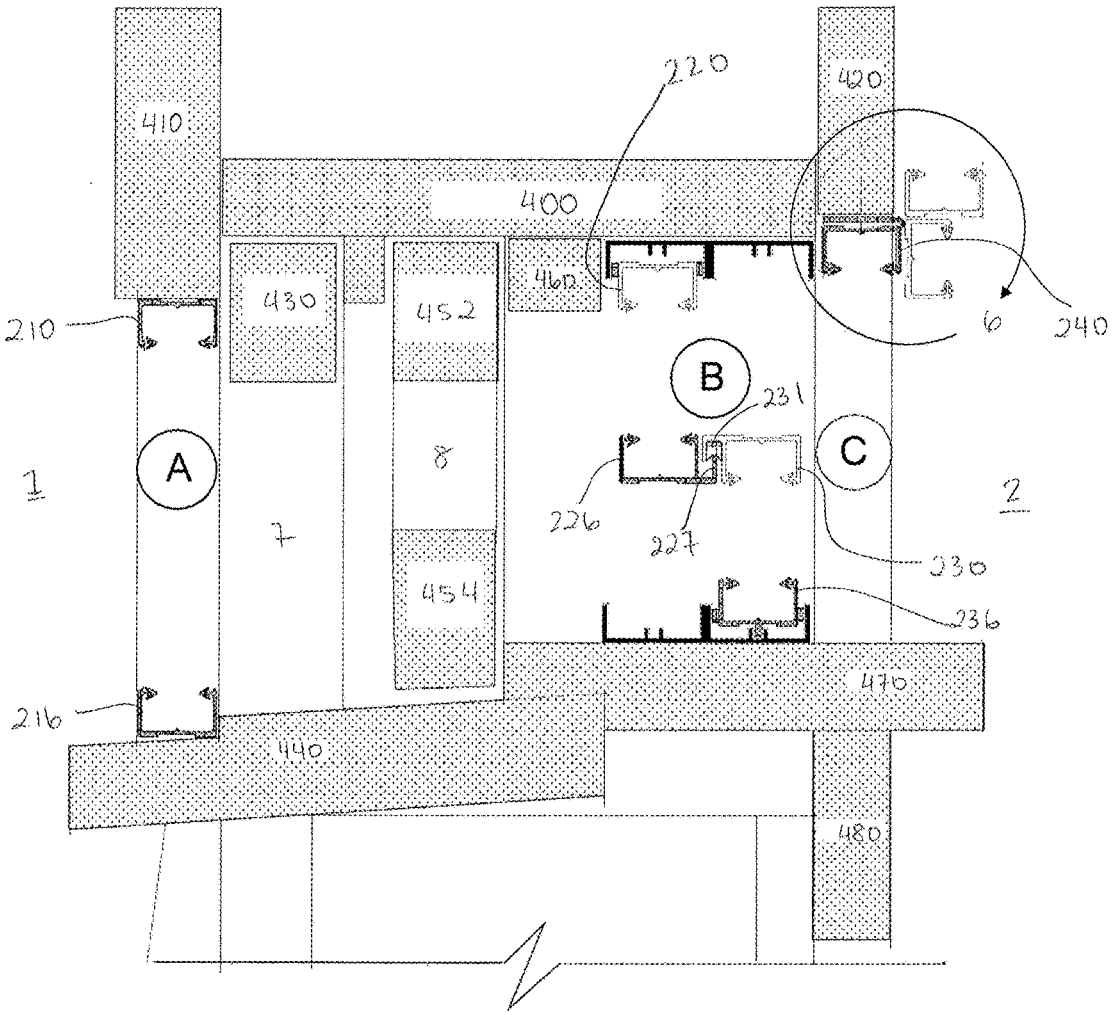
FIG. 5 is a vertical cross-section of a window frame with fenestration supplement systems incorporated in different positions.

FIG. 5 is a schematic showing examples of different possible positions for a fenestration supplement panel relative to a window frame. FIG. 5 shows a vertical cross-section through a window frame 400 having an upper window 7 and upper sash top rail 430, a lower window 8 and lower sash bottom rail 454 and lower sash stile 452, and a stop 460. The window frame also has an exterior trim 410, interior trim 420, an exterior sill 440, a stool 470 and an apron 480. FIG. 5 illustrates fenestration supplement panels incorporated at three different positions relative to window frame 400. At each position, end caps are included to show how the panel would be attached. The panel itself is omitted from the schematic for clarity.

In position A, a panel is positioned on the exterior side 1 of the windows 7, 8. The panel can be attached to the exterior trim 410 by an upper end cap 210 and attached to the sill 440 by a lower end cap 216. Because the panel in position A is exterior to the windows 7, 8, the panel is exposed to the outside environment. In some embodiments, a panel placed in position A, i.e., exterior to the window(s), may include one or more fenestration supplements that are screens (e.g. for screening out insects/debris)

In some embodiments, one or more fenestration supplement panels may be placed in position B, which is on the interior side 2 of the windows 7, 8. In the embodiment shown in FIG. 5, two vertically sliding panels are used to accommodate the vertically sliding windows 7, 8. An upper panel can be attached to the window frame 400 via end caps 220 and 226 and a lower panel can be attached to the stool 470 via end caps 230 and 236. One or both of the upper and lower panels slide vertically relative to the window frame 400 along a track. A seal is formed between the upper and lower panels when a protrusion 227 of end cap 226 abuts against the gasket 231 of end cap 230.

It should be understood that, in other embodiments, panels that slide horizontally relative to the window frame may be used instead of panels that slide vertically relative to the window frame.

Figure 6:
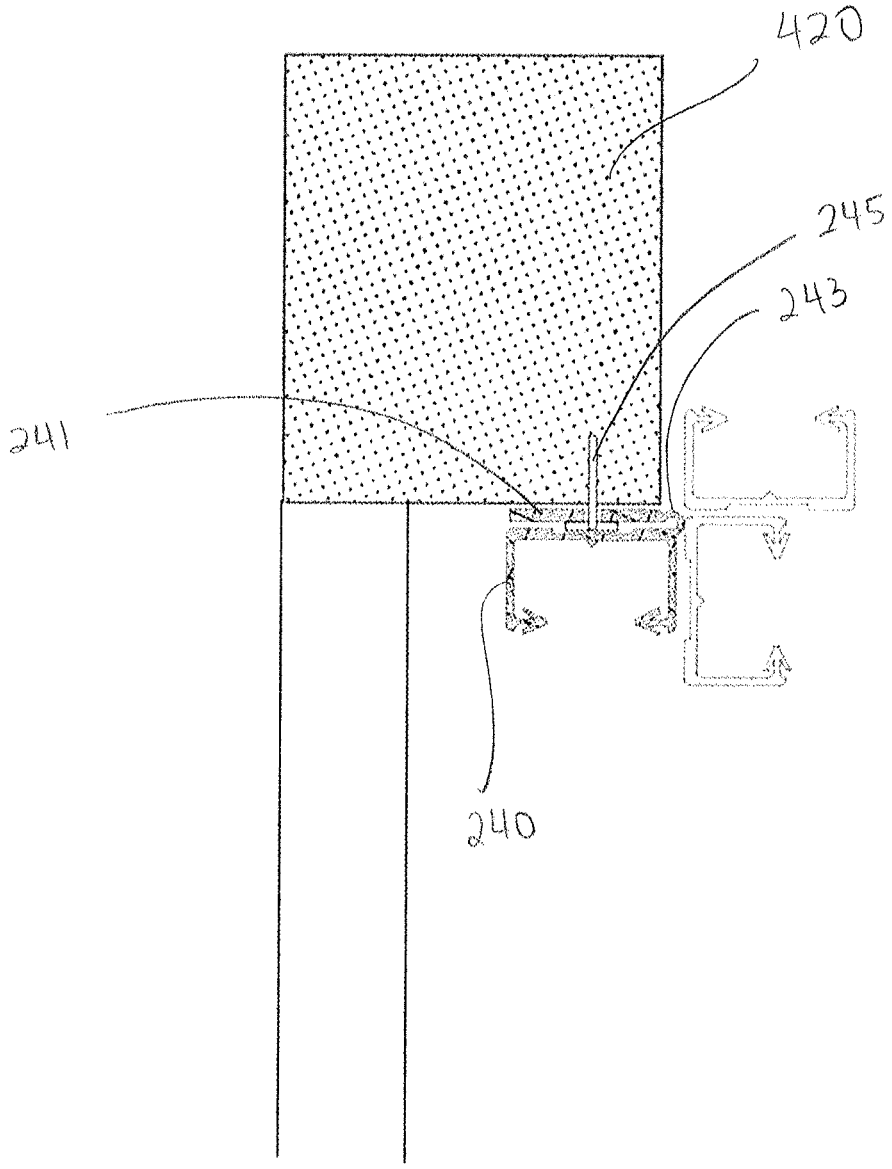
FIG. 6 is a detailed view of the living hinge arrangement depicted in FIG. 5.

Finally, in some embodiments, a fenestration supplement panel may be placed in position C, which is also on the interior side 2 of the windows 7, 8. The panel is situated between the interior trim 420 and the stool 470. In some embodiments, such as the one shown in FIG. 5, the panel may be connected via a hinged arrangement. End cap 240 attaches a panel to the interior trim 420. Encircled section 6 of FIG. 5 shows the end cap 240 rotating to two different positions. FIG. 6 depicts an enlargement of section 6 of FIG. 5. The end cap 240 is connected to an attachment surface 241 via a hinge 243 that allows the end cap 240 to pivot relative to the attachment surface 241. In some embodiments, the hinge is a living hinge. With a fastener attaching the attachment surface 241 to the interior trim 420, the end cap 240 can pivot relative to the interior trim 420. A fenestration supplement panel coupled to the end cap 240 can then be pivoted from a closed position up to an open position relative to the window trim.

In some embodiments, the frame member has biaxial symmetry. As seen in FIG. 2, the first axis 100 of the frame member 10 bisects the frame member, and the second axis 110 bisects the frame member, where the first and second axes 100, 110 are perpendicular to one another. Such biaxial symmetry may reduce the amount of rotating/flipping of the frame member needed during installation to achieve the correct orientation, thereby facilitating installation. Biaxial symmetry may also permit the frame member to be used in a variety of configurations. For example, the frame member may be used in a 3-way or 4-way intersection. As such, the frame member may serve as a mullion.

In accordance with one aspect, the frame member cross-section includes a strip of material 70 running through the center of the cross-section. The cross-section may include a first void 61 and a second void 62 on either side of the strip of central material 70. Without wishing to be bound by theory, using such a cross-sectional shape may help to resist bending or other deflection of the frame member while making an efficient use of material. As will be discussed in a later section, connectors may be inserted into the voids 61, 62 to connect one or more frame members together.

It should be appreciated that, in other embodiments, the frame member does not include a strip of material running through the center of the cross-section. In some cases, the frame member may have a single void instead of two.

Figure 7A:
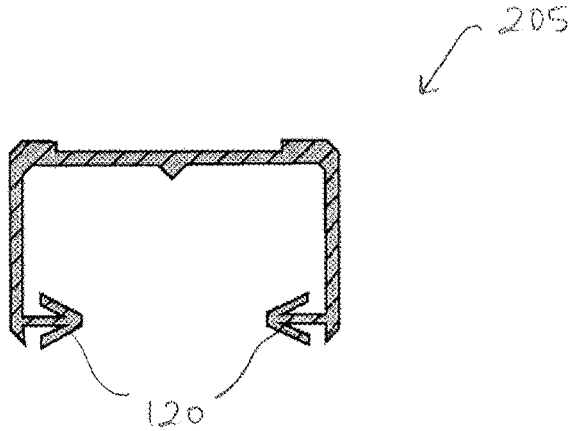
FIG. 7A depicts a cross-sectional view of a first embodiment of an end cap.
Figure 7B:
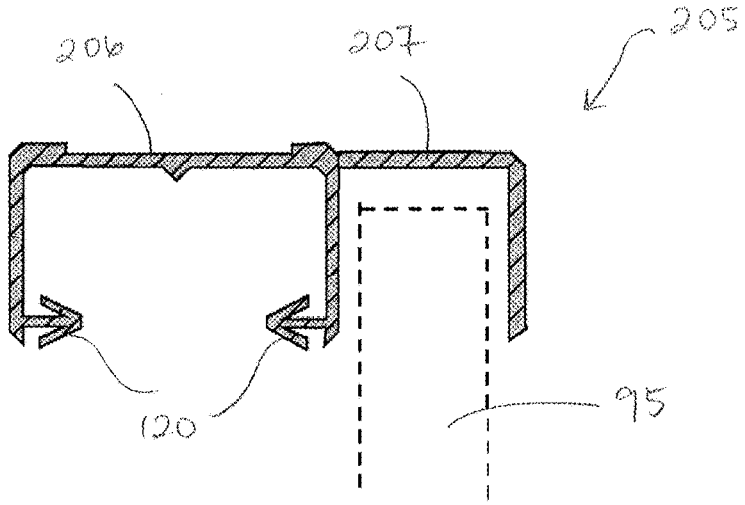
FIG. 7B depicts a cross-sectional view of a second embodiment of an end cap having a membrane holding portion.

FIG. 7A depicts a cross-sectional view of a first embodiment of an end cap 205. The end cap may include snap-in connectors 120 that are received within the grooves of a frame member. Other embodiments of the end cap are possible. For example, FIG. 7B depicts a second embodiment of an end cap 205, where the end cap has a first portion 206 and a second portion 207. The first portion 206 includes connectors 120 that attach the end cap to a frame member. The second portion 207 includes a recess for holding a fenestration accessory 95 such as a shade or a blind.

Figure 7D:
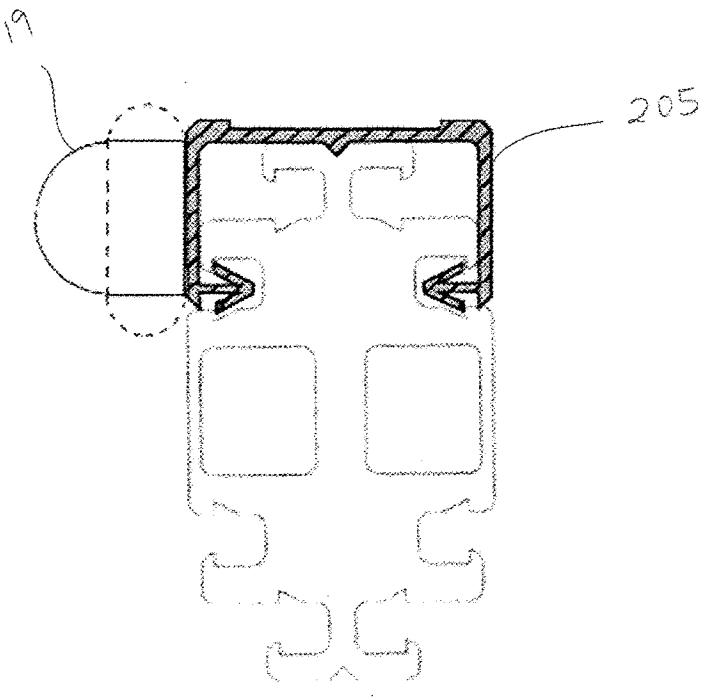
FIG. 7D depicts a cross-sectional view of a fourth embodiment of an end cap having a facial gasket.
Figure 7C:
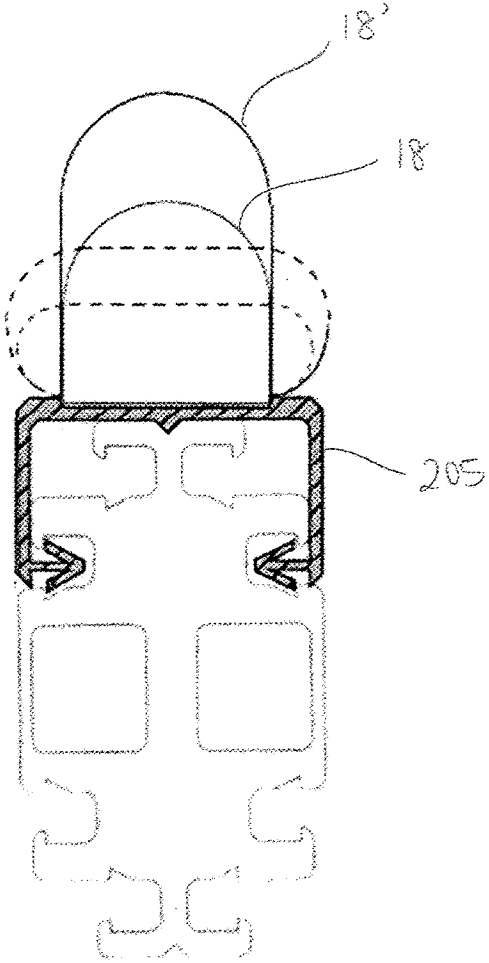
FIG. 7C depicts a cross-sectional view of a third embodiment of an end cap having an edge gasket.

In some embodiments, end caps may be used with gaskets for air sealing. The gasket may be attached to the end cap, or may be held between the end cap and a second opposing surface via friction. In one illustrative embodiment, seen in FIG. 7C, end cap 205 may have an edge gasket 18, which is positioned at the top of the end cap. Alternatively, a thicker gasket 18' can be used. The solid lines represent the uncompressed profile of the gaskets, and the dashed lines represent the compressed profile of the gaskets. In another illustrative embodiment, seen in FIG. 7D, an end cap 205 may have a facial gasket 19, which is positioned on the side of the end cap.

In some embodiments, the frame member has V-shaped grooves located at one or both of the opposing ends. As seen in FIG. 2, in one embodiment, the first portion 11 has a V-shaped groove 81 and the second portion 12 has a V-shaped groove 82. The V-shaped groove may help properly align the frame member with a coupled component. For example, as seen in FIG. 8, a V-shaped protrusion 36 of an adapter 35 is received within the V-shaped groove 82. In this embodiment, the adapter 35 is used to connect a snap-in connector 121 to a rigid membrane 94. Inserting the V-shaped protrusion 36 of the adapter 35 into the V-shaped groove 82 of the frame member 10 helps to properly align the adapter 35 and the membrane 94 with the frame member 10.

In accordance with yet another aspect, the frame member for a fenestration supplement panel includes specially shaped grooves that can accept and retain different types of connectors. These different connectors may be used to accommodate different types of fenestration supplements, thus allowing the frame member to be used with different types of fenestration supplements.

Figure 9:
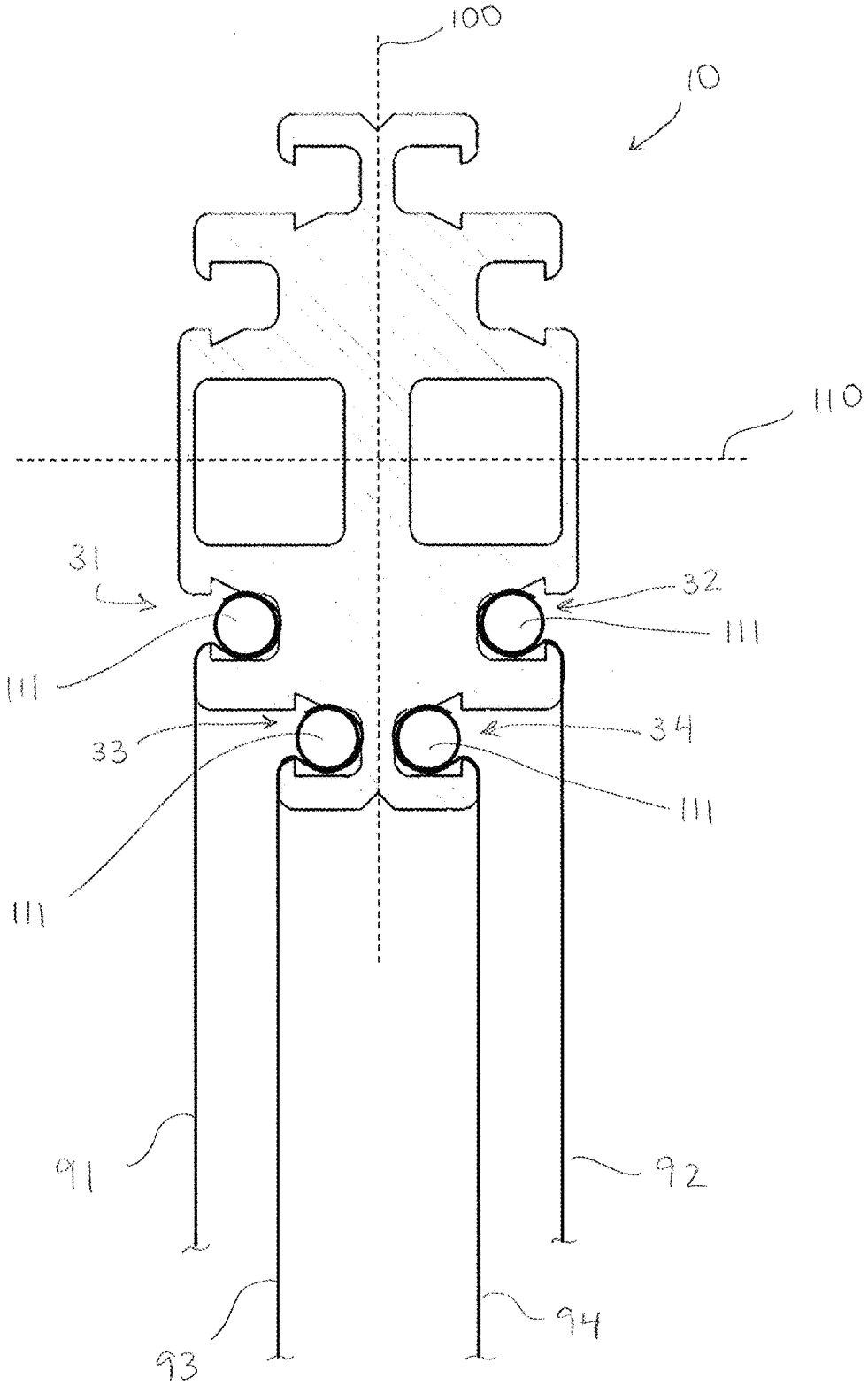
FIG. 9 is an enlarged view of a fenestration supplement frame member with compressible connectors coupling fenestration supplements to the frame member according to one embodiment.

For example, in one illustrative example seen in FIG. 9, a compressible connector 111 can be used to retain fenestration supplements that are flexible, e.g., flexible film membranes or screens. In one embodiment, the compressible connector 111 is wedged into the groove 31 of the frame member and is retained within the groove via an interference fit. The connector 111 at resting state is slightly larger than the groove 31, but the connector can be compressed to fit into the groove. Once inside the groove, the connector expands slightly to remain wedged within the groove. An edge portion of the fenestration supplement can be placed under the compressible connector as the connector is inserted into the groove, thereby wedging the edge portion of the fenestration supplement between the connector and the inner surfaces of the groove. As a result, the fenestration supplement is attached to the frame member.

In some situations, it may be desirable to use a rigid fenestration supplement to supplement a fenestration. In some cases surface applied films must be applied against a rigid surface. As such, using a rigid fenestration supplement permits surface applied films to supplement a fenestration. Examples of surface applied films include tinted films, spectrally selective films and low-emissivity films, also called "low-e" films. Spectrally selective films can be used to block certain wavelengths, e.g., to block ultraviolet light.

The inventor has appreciated that, in some cases, compressible connectors may not be suitable for use with rigid fenestration supplements because rigid fenestration supplements cannot be flexibly curved into the frame member groove and wedged between the compressible connector and the inner surfaces of the groove.

As such, in accordance with one aspect, a snap-in connector can be used to couple rigid fenestration supplements to the frame member. As seen in FIG. 8, snap-in connectors 120, 121 are used to couple fenestration supplements 91, 92, 93, 94 to the frame member 10.

An adapter 35 can be used to allow the snap-in connector 121 to attach to a rigid membrane 94. In some embodiments, the adapter and snap-in connector form a single, permanently attached component. For example, the snap-in connector and adapter are integrally formed as one monolithic component, or can be formed as two components that are permanently bonded together. In other embodiments, the adapter is removably attachable to the snap-in connector such that the snap-in connector can be used with the adapter or without the adapter.

In some embodiments, snap-in connectors can be used with both rigid and flexible fenestration supplements. As seen in FIG. 8, while snap-in connector 121 is used to couple a rigid membrane 94 to the frame member 10, other snap-in connectors 120 are used to couple flexible fenestration supplements 91, 92 and 93 to the frame member 10. Similar to the compressible connectors, the snap-in connectors can couple flexible fenestration supplements to the frame member by wedging the fenestration supplement between the groove and the snap-in connector. In other embodiments, instead of wedging the flexible fenestration supplement into the groove, the snap-in connector may be attached to the edges of the fenestration supplement, and only the snap-in connector is inserted into the frame member grooves.

Figure 10:
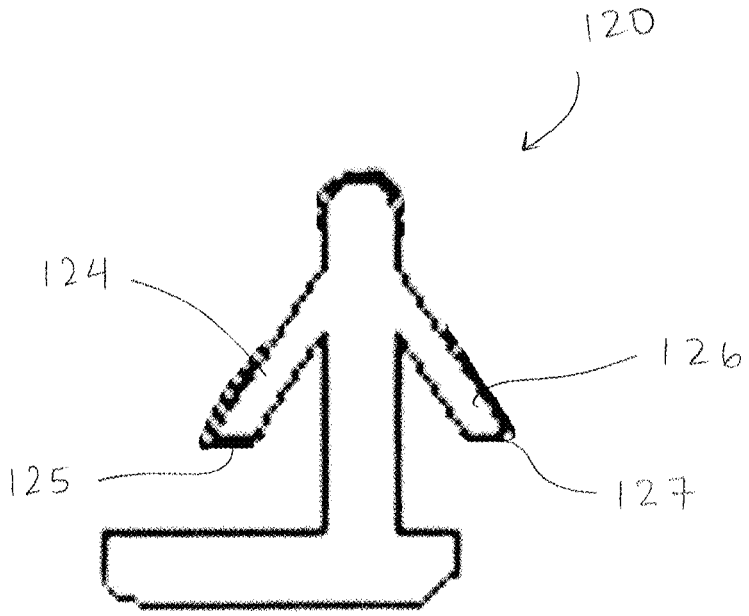
FIG. 10 is an enlarged view of a snap-in connector according to one embodiment.

The geometry of the snap-in connector will now be discussed in detail. As seen in FIG. 10, the snap-in connector 120 includes two wings 124, 126 that are inwardly compressible toward one another in a first stressed state. The wings are biased toward a second unstressed state in which the wings are angled away from one another. The wings are shown in the unstressed state in FIG. 10. Each wing 124, 126 has a corresponding wing tip 125, 127.

In some embodiments, the frame member grooves may have a shape to accommodate the shape of the snap-in connector. In one embodiment, shown in FIG. 2, the frame member groove 21 has a corresponding J-shaped flange 41 that bounds one side of the groove and an angled flare 53 that is indented into the other, opposing side of the groove. The J-shaped flange includes a first land 51 and the angled flare 53 includes a second land 52. The first and second lands 51, 52 are flat surfaces located within the groove 21.

When the snap-in connector 120 is first inserted into a groove, the wings 124, 126 are pushed inwardly toward one another due to contact with surfaces of the groove at the groove entrance. Once the wings clear the surfaces at the groove entrance, the wings are free to expand inside the groove, as the span inside the groove is wider than the span at the entrance of the groove. With the snap-in connector fully inserted into the groove, abutment of the wing tips 125, 127 against the inner groove lands 51, 52 retains the connector inside the groove.

In some embodiments, the snap-in connectors may be removed from the frame member groove by squeezing one or both of the wings inwardly and pulling the connector out of the groove.

According to one aspect, the abutment surfaces corresponding to each frame member groove may be recessed relative to the frame member faces to allow panel assemblies to be stacked on top of one another without damaging the fenestration supplements. In one illustrative embodiment shown in FIG. 2, the frame member 10 has a first face 13 and an opposing second face 14. The first face 13 is parallel to the first axis 100. The abutment surface 71, which is parallel to the first axis 100 and the first face 13, is recessed relative to the first face 13 along the second direction 112. A fenestration supplement coupled to the groove 31 associated with the abutment surface 71 will sit flush with the abutment surface 71 and will be spaced apart from the first face 13 along the second direction 112. In practice, panel assemblies may be stacked on top of one another for ease of storage and/or transport. By recessing the fenestration supplements back from the outermost planes of the frame (first face 13 and second face 14 in FIG. 2), the fenestration supplements are less likely to rub against one another or against other frames, which may help to prevent the fenestration supplements from being scratched, punctured, or otherwise damaged.

It should be appreciated that fenestration supplements may be attached to the frame member in different arrangements to best suit a particular function. For example, to filter out bugs and debris, a screen may be attached to the frame at the most external position. In another example, to act as a storm window-type component, a rigid membrane may be attached to the frame at the most external position. In yet another example, in some cases, a rigid membrane may be used to protect flexible membranes from puncture caused by activity occurring on the interior side of the panel (e.g., due to scratching from indoor pets, projectiles thrown by children, etc.). In such cases, the rigid membrane may be attached to the frame at the most internal position.

Figure 11:
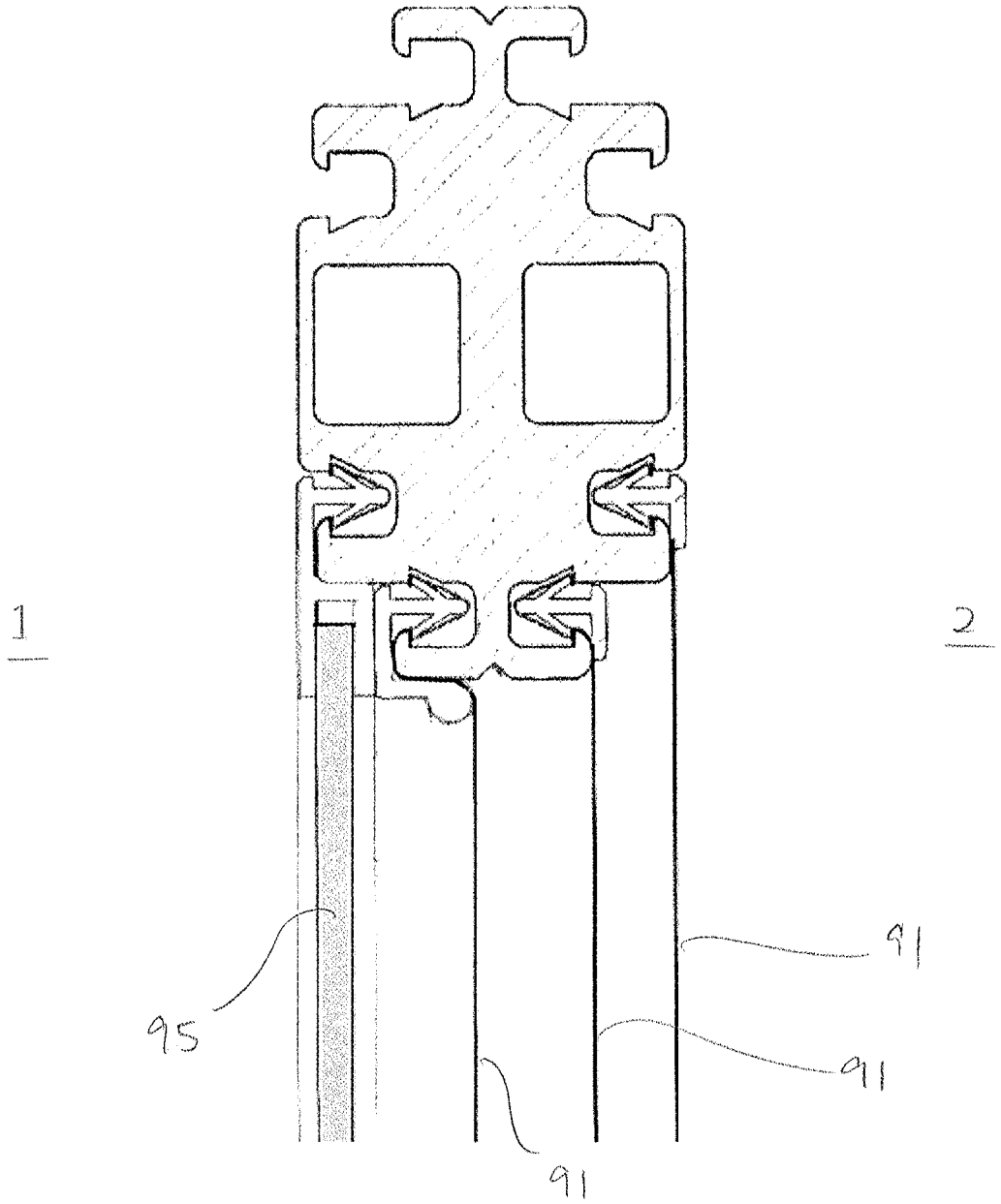
FIG. 11 depicts an enlarged view of a fenestration supplement frame member coupled to a rigid membrane serving as a storm window-type component.
Figure 12:
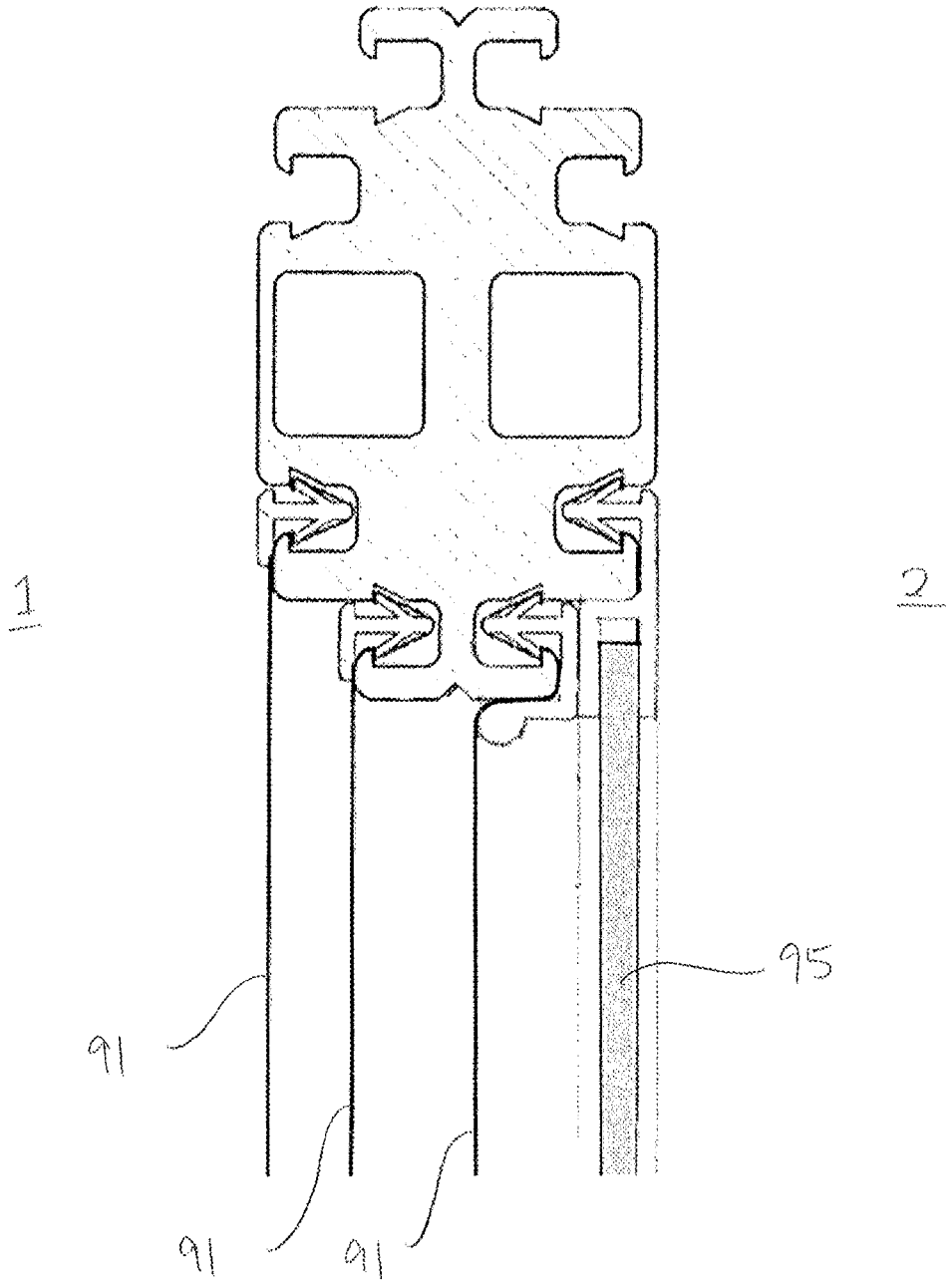
FIG. 12 depicts an enlarged view of a fenestration supplement frame member coupled to a rigid membrane serving as a protective component.

In one illustrative embodiment shown in FIG. 11, a rigid membrane 95 is positioned at the most exterior position, closest to the exterior side 1. In this situation, the rigid membrane is used as an exterior storm window-type component. In another illustrative embodiment shown in FIG. 12, a rigid membrane 95 is positioned at the most interior position, closest to the interior side 2. In this situation, the rigid membrane is used as a protective membrane that protects the other flexible membranes 91 from puncture due to activity occurring on the interior side 2.

In accordance with yet another aspect, the fenestration supplement frame members are joined to one another via intermediate connecting components. In some embodiments, multiple frame members may be joined to form a frame. The intermediate connecting component may be a corner piece or may be "invisible" to form a miter.

Figure 13A:
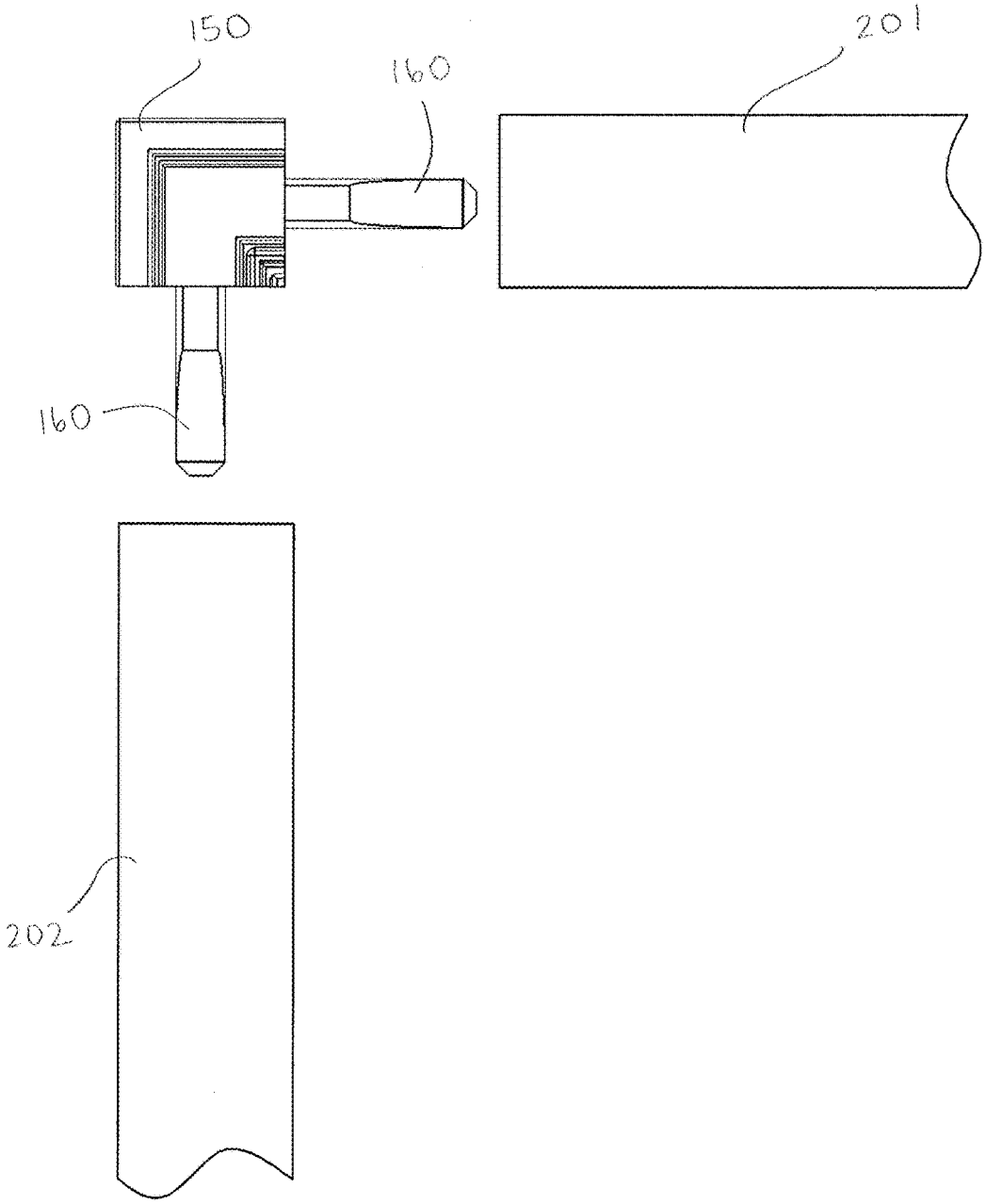
FIG. 13A depicts an exploded view of a connecting component and two frame members.
Figure 13B:
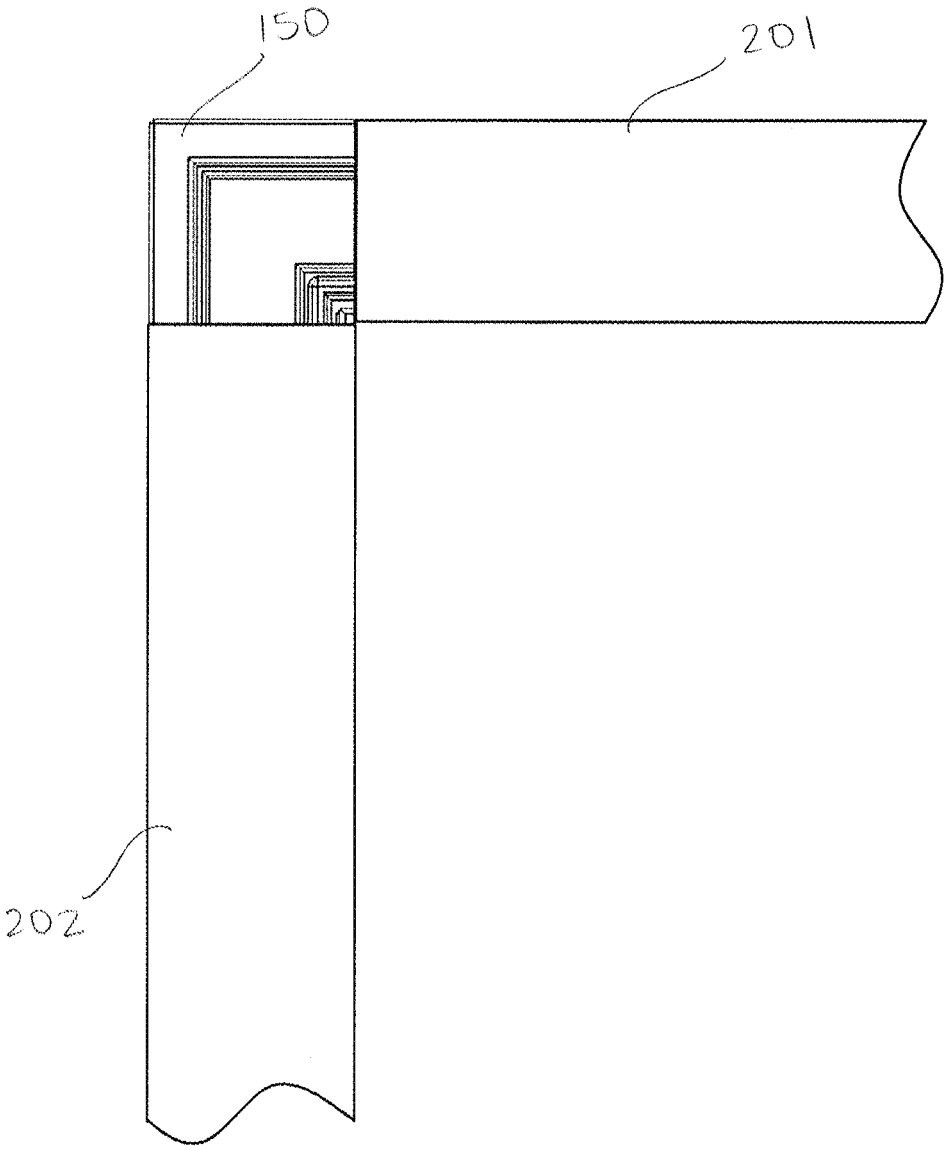
FIG. 13B depicts the two frame members of FIG. 13A joined together via a connecting component.

One illustrative embodiment is shown in FIG. 13A, in which a first frame member 201 is connected to a second frame member 202 via frame member connector 150. The frame member connector 150 has prongs 160 that are inserted into the voids of the frame members (see FIG. 2 for voids 61, 62). With the connector prongs inserted into the voids of the frame members, the two frame members 201, 202 are connected together, as shown in FIG. 13B. The frame members may retain the prongs within the voids via any suitable arrangement, for example, a snap-in fit, an interference fit, adhesive, fasteners, etc.

Figure 14:
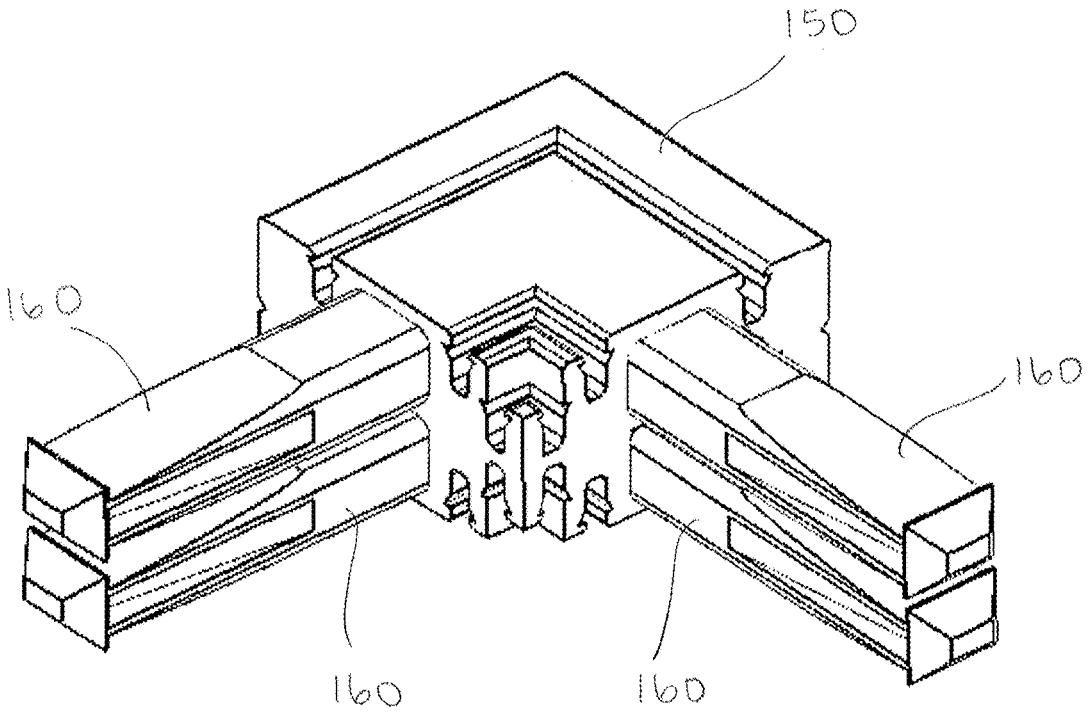
FIG. 14 is a perspective view of a connecting component with prongs.

An illustrative embodiment of a connector is shown in FIG. 14, which depicts a perspective view of a frame member connector 150 having four prongs 160. Two prongs extend from one face, and the other two prongs extend from another face. The embodiment shown in FIG. 14 is a connector used to connect two frame members together at right angles. In another embodiment, a connector can have prongs situated on opposite faces of the connector such that the connector can be used to connect two frame members together linearly (i.e., in line with one another).

FIG. 15 depicts a fully assembled frame 300 with four frame members 201, 202, 203 and 204. The frame members are connected to one another via frame member connectors 150. In the embodiment shown in FIG. 15, the frame member connectors 150 are visible. However, in other embodiments, the ends of the frame members may be mitered (i.e. beveled such that the ends of two frame members form a corner when brought in contact). The connectors may then be sized and shaped as prongs that entirely fit within the voids of the frame members, and therefore obscured from view when the frame is fully assembled.

Figure 16A:
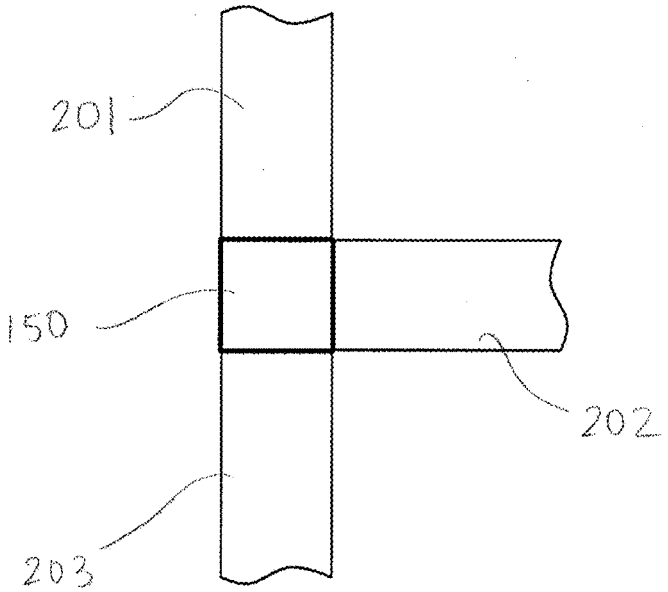
FIG. 16A depicts a connector joining three frame members together.
Figure 16B:
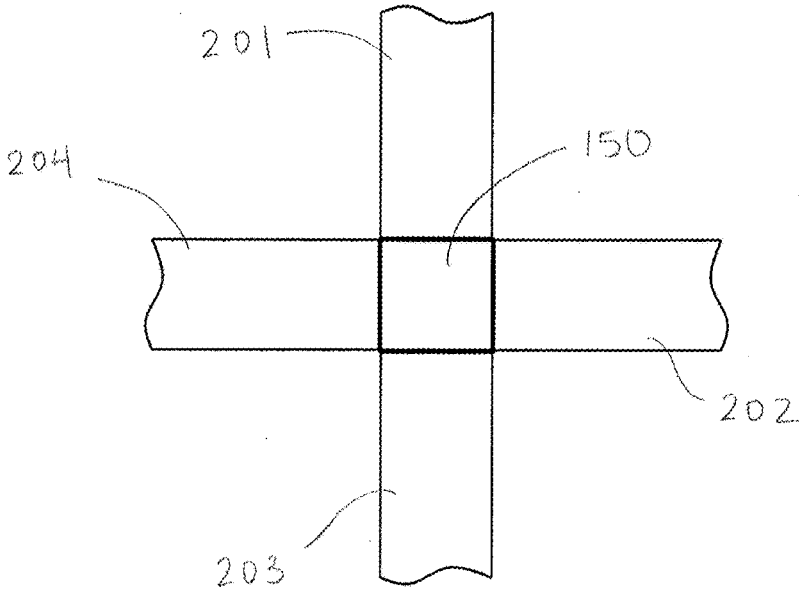
FIG. 16B depicts a connector joining four frame members together.

It should be appreciated that the connector can have prongs on more than two faces in order to connect more than two frame members together. For example, as seen in FIG. 16A, a frame member connector 150 is used to connect three frame members 201, 202, 203 together. In another embodiment depicted in FIG. 16B, a frame member connector 150 is used to connect four frame members 201, 202, 203, 204 together.

The inventor has recognized that conventional fenestration supplement panels require the panel to be either installed in a position covering the fenestration, or removed completely and stored elsewhere when covering the fenestration is not desired. As such, with conventional panels, with the panel installed and mounted to the window arrangement, the windows cannot be opened. The fenestration supplement must be completely detached and removed from the window arrangement before the window can be opened. As a result, with such conventional panels, with the panel installed, the functionality of the window is lost.

According to one aspect, the geometry of the fenestration supplement frame member permits fenestration supplements to be movably mounted to an existing fenestration arrangement such that the fenestration supplement need not be entirely removed from the fenestration arrangement when operating the fenestration (e.g. opening a window or door). In some embodiments the frame member is dual-ended, with one end that couples to one or more fenestration supplements, and a second end that can couple to various kinds of mounting hardware that are used to movably mount the fenestration supplement to the fenestration arrangement.

For example, the fenestration supplement may be slidably mounted to a fenestration arrangement. In one embodiment, two fenestration supplements are used, and one or both of the supplements can slide vertically or horizontally relative to the other. In the closed position, the frame member at the end of one supplement mates with the frame member at the end of the other supplement to form a seal.

Figure 17A:
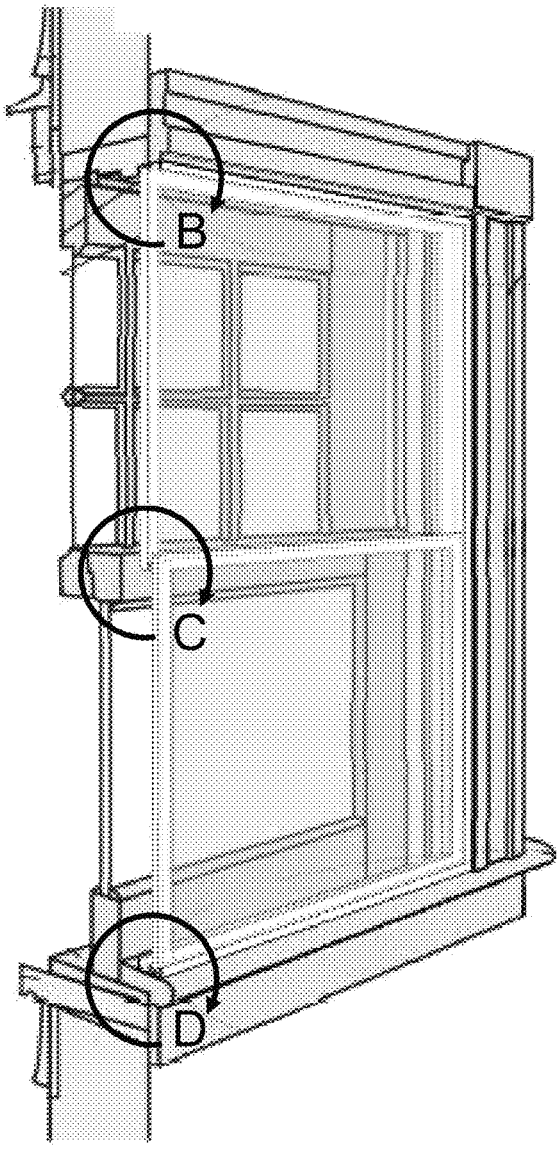
FIG. 17A depicts vertically sliding panels supplementing a window according to one embodiment.
Figure 17B:
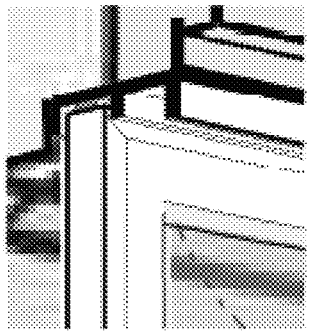
FIG. 17B depicts section B-B of FIG. 17A, detailing an upper track of the embodiment.
Figure 17C:
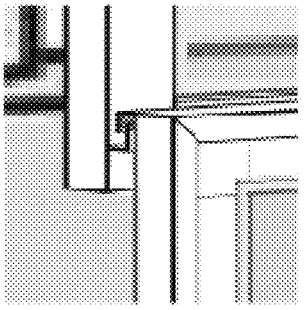
FIG. 17C depicts section C-C of FIG. 17A, detailing a meeting rail between panels of a vertically sliding embodiment.
Figure 17D:
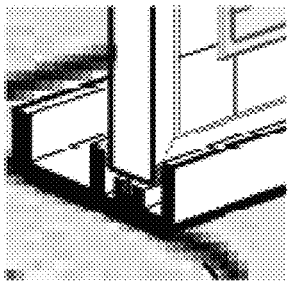
FIG. 17D depicts section D-D of FIG. 17A, detailing a lower track of the embodiment.

FIGS. 17A-D depict one illustrative embodiment of a fenestration supplement system in which fenestration supplement panels are slidably mounted such that the lower panel slides upwardly relative to the window frame. The panels are shown in the closed position. As seen in FIG. 17B, the top frame member of the higher panel seals against the window frame. As best seen in FIG. 17C, in the closed position, the bottom frame member of the higher panel mates with the top frame member of the lower panel. As seen in FIG. 17D, the bottom frame member of the lower panel sits within a sill track that allows the lower panel to slide vertically. It should be appreciated that the arrangement shown in FIG. 17A can be modified such that the higher panel slides rather than the lower, both panels slide and/or the arrangement is changed to horizontal sliding rather than vertical sliding.

As another example, the fenestration supplement panel may be pivotally mounted to a fenestration arrangement (e.g. a window frame or door frame). A hinge type mounting hardware may be coupled to one end of the frame member, and one or more fenestration supplements may be coupled to the other end of the frame member. The hinge permits the fenestration supplement to rotate relative to the window/door frame. In some embodiments, the hinge is a living hinge.

Figure 18B:
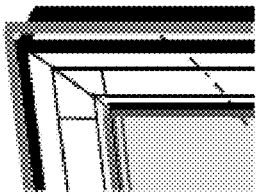
FIG. 18B depicts section B-B of FIG. 18A, detailing an enlarged isometric view of a top corner of the embodiment.
Figure 18C:
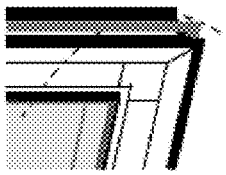
FIG. 18C depicts section C-C of FIG. 18A, detailing an enlarged isometric view of a bottom corner of the embodiment.
Figure 18A:
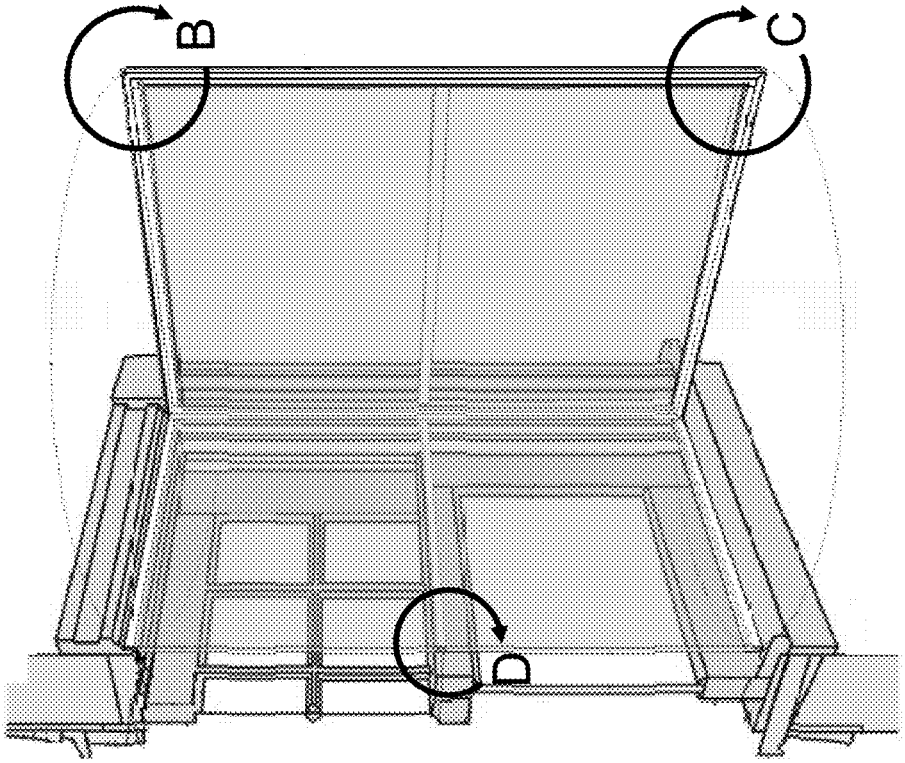
FIG. 18A depicts a hinged panel supplementing a window according to one embodiment.
Figure 18D:
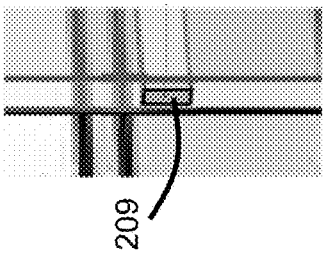
FIG. 18D depicts section D-D of FIG. 18A, detailing an enlarged isometric section view of a horizontally aligned muntin located between two fenestration supplements.

FIGS. 18A-D depict one illustrative embodiment of a fenestration supplement system in which a fenestration supplement panel is pivotally mounted to a fenestration arrangement such that the supplement can rotate away from the window frame. In some embodiments, a gasket may be included around the perimeter of the panel to create a seal against the window frame when the panel is pivoted to the closed position. The gasket can be seen running over the corners of the panel in FIGS. 18B and 18C. FIG. 18D shows a frame member 209 serving as a muntin.

The above aspects and embodiments may be employed in any suitable combination, as the present invention is not limited in this respect.

The aspects described herein refer to embodiments in which the frame member is used in a fenestration supplement system. However, it should be appreciated that the frame member described herein may be used for other purposes as well. For example, the frame member may be used as a primary fenestration device in certain situations. In addition, the frame member may be used a framing system for non-fenestration applications such as art, craft and cabinetry.

It should also be understood that, unless clearly indicated to the contrary, in any methods claimed herein that include more than one step or act, the order of the steps or acts of the method is not necessarily limited to the order in which the steps or acts of the method are recited.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A fenestration supplement frame member, comprising:

an elongated body having a cross-section with a first axis in a first direction and a second axis in a second direction, the first and second directions being perpendicular to one another, the elongated body having first, second and third connector grooves sized to receive and retain a connector, the first connector groove having a corresponding first abutment surface, the second connector groove having a corresponding second abutment surface and the third connector groove having a corresponding third abutment surface, wherein:

the third abutment surface is spaced apart from the first abutment surface in the first direction and in the second direction, and the third abutment surface is spaced apart from the second abutment surface in the first direction and in the second direction, wherein the cross-section of the elongated body has biaxial symmetry such that the second axis bisects the cross-section into a top portion and a bottom portion and the first axis bisects the cross-section into a left portion and a right portion.

2. The fenestration supplement frame member of claim 1, wherein the first abutment surface and second abutment surface are aligned along the second direction and spaced apart in the second direction.

3. The fenestration supplement frame member of claim 1, further comprising a fourth connector groove having a corresponding fourth abutment surface, wherein:

the fourth abutment surface is spaced apart from the first abutment surface in the first direction and in the second direction, and the fourth abutment surface is spaced apart from the second abutment surface in the first direction and in the second direction.

4. The fenestration supplement frame member of claim 3, wherein the third abutment surface and fourth abutment surface are aligned along the second direction and spaced apart in the second direction.

5. The fenestration supplement frame member of claim 1, wherein the first, second and third connector grooves are each bounded by a J-shaped flange.

6. The fenestration supplement frame member of claim 1, wherein the first, second and third connector grooves each include an angled flare formed into the elongated body.

7. The fenestration supplement frame member of claim 1, wherein the cross-section of the elongated body comprises material running along the first axis from a top end of the elongated body to a bottom end of the elongated body.

8. The fenestration supplement frame member of claim 1, further comprising a first V-shaped groove at a top end of the elongated body.

9. The fenestration supplement frame member of claim 8, further comprising a second V-shaped groove at a bottom end of the elongated body.

10. The fenestration supplement frame member of claim 1, further comprising a first hollow void running through the elongated body.

11. The fenestration supplement frame member of claim 10, further comprising a second hollow void running through the elongated body.

12. A fenestration supplement panel, comprising:

a fenestration supplement;

a connector; and a first fenestration supplement frame member comprising an elongated body having a cross-section with a first axis in a first direction and a second axis in a second direction, the first and second directions being perpendicular to one another, the elongated body having first, second and third connector grooves sized to receive and retain the connector and a portion of the fenestration supplement, the first connector groove having a corresponding first abutment surface, the second connector groove having a corresponding second abutment surface, and the third connector groove having a corresponding third abutment surface, wherein:

the connector couples the fenestration supplement to the first fenestration supplement frame member by holding the portion of the fenestration supplement inside the first connector groove, the third abutment surface is spaced apart from the first abutment surface in the first direction and in the second direction, and the third abutment surface is spaced apart from the second abutment surface in the first direction and in the second direction, and the connector comprises a snap fit connector comprising two wings being inwardly compressible toward one another in a first stressed state and being biased toward a second unstressed state in which the wings are angled away from one another.

13. The fenestration supplement panel of claim 12, wherein the fenestration supplement comprises a film membrane.

14. The fenestration supplement panel of claim 12, wherein the fenestration supplement comprises a screen.

15. The fenestration supplement panel of claim 12, wherein the fenestration supplement comprises a rigid membrane.

16. The fenestration supplement panel of claim 12, wherein, in an unstressed state, the connector is larger in size than each of the first, second and third connectors grooves, and wherein insertion of the connector into each of the first, second and third connectors grooves requires compression of the connector.

17. The fenestration supplement panel of claim 12, further comprising a second fenestration supplement frame member joined to the first fenestration supplement frame member via a connecting component.

18. The fenestration supplement panel of claim 17, further comprising third and fourth fenestration supplement frame members joined to the first and second fenestration supplement frame members to form a rectangular frame.

* * * * *